US010125438B2

(12) United States Patent
Yip et al.

(10) Patent No.: US 10,125,438 B2
(45) Date of Patent: Nov. 13, 2018

(54) BOW MAKING DEVICE WITH INTERCHANGEABLE COMPONENTS

(71) Applicant: Berwick Offray LLC, Berwick, PA (US)

(72) Inventors: Yi-Ling Yip, Kearny, NJ (US); Patrick Daniel Corcoran, Pompton Lakes, NJ (US)

(73) Assignee: Berwick Offray LLC, Berwick, PA (US)

( * ) Notice: Subject to any disclaimer, the term of this patent is extended or adjusted under 35 U.S.C. 154(b) by 0 days.

(21) Appl. No.: 15/446,294

(22) Filed: Mar. 1, 2017

(65) Prior Publication Data

US 2018/0251923 A1 Sep. 6, 2018

(51) Int. Cl.
*D04D 7/10* (2006.01)
*D04D 11/00* (2006.01)

(52) U.S. Cl.
CPC ..... *D04D 7/10* (2013.01); *D04D 11/00* (2013.01)

(58) Field of Classification Search
CPC .. D04D 7/10; D04D 7/02; D04D 7/00; D04D 7/04; D04D 7/05; D04D 11/00; A41G 1/02
See application file for complete search history.

(56) References Cited

U.S. PATENT DOCUMENTS

| | | | |
|---|---|---|---|
| 696,361 | A | 3/1902 | Chase |
| 1,010,155 | A | 11/1911 | Lange |
| 1,307,069 | A | 6/1919 | Weismantel |
| 1,598,310 | A | 8/1926 | Quinlan |
| 2,077,370 | A | 4/1937 | Reynolds |
| 2,105,436 | A | 1/1938 | Flatto |
| 2,107,194 | A | 2/1938 | Yacker et al. |
| 2,521,863 | A | 9/1950 | Mertz |

(Continued)

FOREIGN PATENT DOCUMENTS

WO WO 97/01970 * 1/1997

OTHER PUBLICATIONS

Bowdabra (from Archive.org), available at http://web.archive.org/web/20080612035745/http://www.bowdabra.com/ (at least as early as Jun. 12, 2008 per Archive.org) (2 pages).

(Continued)

*Primary Examiner* — Ismael Izaguirre
(74) *Attorney, Agent, or Firm* — McCarter & English, LLP

(57) ABSTRACT

A bow maker set with interchangeable components is disclosed herein. In one embodiment, a bow making device kit includes a base assembly having a body component defining a needle mounting receptacle, a catch mounting receptacle, and fork mounting grooves. The bow making device kit could also include a needle assembly removably attachable to the needle mounting receptacle. The bow making device kit could also include a plurality of forks removably attachable to the fork mounting grooves. Each fork could have a base with a plurality of prongs extending therefrom. The plurality of forks circumscribe the needle assembly when the needle assembly and the plurality of forks are attached to the base assembly. The bow making device kit could also include a catch assembly removably attachable to the catch mounting receptacle. The catch assembly could have a plurality of fingers with movable inserts biased inwardly to contact each other.

33 Claims, 10 Drawing Sheets

(56) References Cited

U.S. PATENT DOCUMENTS

| | | | | | |
|---|---|---|---|---|---|
| 2,528,820 | A | * | 11/1950 | Cook | D04D 7/10 223/46 |
| 2,542,222 | A | | 2/1951 | Welch | |
| 2,569,943 | A | | 10/1951 | Mitchell | |
| 2,666,249 | A | | 1/1954 | Ruiz et al. | |
| 2,763,080 | A | | 9/1956 | Welch | |
| 2,828,896 | A | | 4/1958 | Hanselman | |
| 2,905,368 | A | * | 9/1959 | Runyan | D04D 7/10 223/46 |
| 3,044,670 | A | * | 7/1962 | Barefoot | D04D 7/10 223/46 |
| 3,061,153 | A | | 10/1962 | Rector | |
| 3,126,093 | A | | 3/1964 | Bradley et al. | |
| 3,194,459 | A | * | 7/1965 | Knox | D04D 7/10 223/46 |
| 3,214,070 | A | | 10/1965 | Twigg | |
| 3,223,440 | A | | 12/1965 | Rosenzweig | |
| 3,236,426 | A | | 2/1966 | Kerrigan et al. | |
| 3,286,888 | A | | 11/1966 | Cuttler et al. | |
| 3,289,900 | A | | 12/1966 | Mashburn, Jr. et al. | |
| 3,305,100 | A | * | 2/1967 | Barbee | A47L 13/512 211/120 |
| 3,377,674 | A | | 4/1968 | Brassaw et al. | |
| 3,411,677 | A | * | 11/1968 | Bickner | D04D 7/10 223/46 |
| 3,428,227 | A | | 2/1969 | Cavoli | |
| 3,462,049 | A | | 8/1969 | Smith | |
| 3,501,070 | A | | 3/1970 | Shattuck | |
| 3,816,888 | A | | 6/1974 | Rather, Jr. | |
| 3,850,293 | A | | 11/1974 | Scaringi | |
| 3,854,179 | A | | 12/1974 | Montoya | |
| 4,186,833 | A | | 2/1980 | Homan | |
| 4,337,578 | A | | 7/1982 | Seals | |
| D266,630 | S | | 10/1982 | O'Brien | |
| 4,410,113 | A | | 10/1983 | Palombo | |
| 4,454,968 | A | | 6/1984 | StLawrence | |
| 4,629,100 | A | | 12/1986 | Owens | |
| 4,714,182 | A | | 12/1987 | Hecht | |
| 5,100,706 | A | | 3/1992 | Zaweski | |
| 5,111,637 | A | | 5/1992 | Weder et al. | |
| 5,111,638 | A | | 5/1992 | Weder | |
| 5,181,364 | A | | 1/1993 | Weder | |
| 5,215,791 | A | | 6/1993 | Davignon | |
| 5,239,804 | A | | 8/1993 | Weder et al. | |
| 5,245,814 | A | | 9/1993 | Weder | |
| 5,261,578 | A | | 11/1993 | Monahan | |
| 5,297,705 | A | | 3/1994 | Schmidt | |
| 5,356,056 | A | | 10/1994 | Teuten | |
| 5,369,934 | A | | 12/1994 | Weder | |
| 5,388,386 | A | | 2/1995 | Weder | |
| 5,407,108 | A | | 4/1995 | Hambright | |
| 5,408,802 | A | | 4/1995 | Weder et al. | |
| 5,411,188 | A | | 5/1995 | Teuten | |
| 5,448,875 | A | | 9/1995 | Weder | |
| 5,456,056 | A | | 10/1995 | Weder | |
| D364,732 | S | | 12/1995 | Hyche | |
| D364,733 | S | | 12/1995 | Cavender | |
| 5,499,759 | A | * | 3/1996 | Richards | D04D 7/10 223/46 |
| 5,509,586 | A | | 4/1996 | Leiser | |
| 5,537,800 | A | | 7/1996 | Weder | |
| 5,560,181 | A | | 10/1996 | Weder | |
| 5,595,046 | A | | 1/1997 | Weder | |
| 5,596,862 | A | | 1/1997 | Weder | |
| 5,617,979 | A | | 4/1997 | Cavender | |
| 5,662,250 | A | | 9/1997 | Werling | |
| D389,998 | S | | 2/1998 | Cavender et al. | |
| D393,147 | S | | 4/1998 | Renshaw | |
| D396,950 | S | | 8/1998 | Werling | |
| 5,810,214 | A | | 9/1998 | Hecht | |
| 5,913,450 | A | | 6/1999 | Runkel | |
| 5,975,383 | A | | 11/1999 | Cavender et al. | |
| 6,000,586 | A | | 12/1999 | Cavender | |
| 6,015,070 | A | * | 1/2000 | Barto, Jr. | D04D 7/10 223/46 |
| 6,131,778 | A | | 10/2000 | Etzion | |
| D483,667 | S | | 12/2003 | Crowley | |
| D580,649 | S | | 11/2008 | Ota | |
| D594,645 | S | | 6/2009 | Oe et al. | |
| D594,646 | S | | 6/2009 | Oe et al. | |
| D594,647 | S | | 6/2009 | Oe et al. | |
| D614,858 | S | | 5/2010 | Ranzau | |
| D615,291 | S | | 5/2010 | Ranzau | |
| D615,746 | S | | 5/2010 | Ranzau | |
| D632,432 | S | | 2/2011 | Holloway | |
| 7,946,456 | B1 | | 5/2011 | Holloway | |
| 8,403,145 | B1 | | 3/2013 | Yip et al. | |
| D682,537 | S | | 5/2013 | Maligno | |
| D741,591 | S | | 10/2015 | Shainwald et al. | |
| D741,592 | S | | 10/2015 | Shainwald et al. | |
| 2008/0073386 | A1 | | 3/2008 | Lavorato | |
| 2009/0294490 | A1 | | 12/2009 | Gustin | |
| 2010/0025438 | A1 | | 2/2010 | Ranzau | |
| 2012/0012621 | A1 | | 1/2012 | Sellers | |
| 2013/0015214 | A1 | | 1/2013 | Ranzau | |

OTHER PUBLICATIONS

Fiskars Bow Maker, available at http://www.fiskarscrafts.com/tools/t.sub.-bow-maker.aspx and available at http://crafts-sewing.hsn.com/fiskars-bow-maker-ultimate-bow-and-floral- -stapler.sub.--p-3331722.sub.-xp.aspx (Prior to Jul. 27, 2009) (4pages).

Itsy Bitsy Bow Maker (from Archive.org), available at http://web.archive.org/web/20071026124534/http://www.packrat-pro.com/bows- /bows.htm and http://web.archive.org/web/20071026165758/http://www.packrat-pro.com/bows- /bowhow1.htm (Oct. 26, 2007 perArchive.org) (6 pages).

Jiffy Bow Maker, available at www.jiffbowmaker.com (prior to Jul. 27, 2009) (additional info at Archive.org) (3 pages).

TheCardLadies Adjustable Bow Maker (from Archive.org), available at http://web.archive.org/web/20080420121139/http://www.thecardladies.com/Bo- wMaker.htm (at least as early as Apr. 20, 2008 per Archive.org) (3 pages).

U.S. Appl. No. 09/109,563, title: Folded Corrugated Material and Method for Producing Same , filed Jul. 2, 1998 (abandoned).

U.S. Office Action for U.S. Appl. No. 29/595,670 dated Nov. 1, 2017.

U.S. Appl. No. 08/133,618, title: Bow Making Apparatus, filed Oct. 7, 1993 (abandoned) (21 pages).

* cited by examiner

BOW MAKING DEVICE WITH INTERCHANGEABLE COMPONENTS

FIELD OF THE DISCLOSURE

Embodiments of the present disclosure relates to a bow making device and, more specifically, to a compact and comprehensive bow making device with interchangeable components.

BACKGROUND

For some people, bow making can be a difficult and time consuming process. Further, many bow making aids are for specific purposes and lack versatility. Additionally, such bow making aids can be large and bulky. Thus, a need exists for a device to assist a user in bow making, which is compact and versatile. These and/or other needs are addressed by embodiments of the bow making device with interchangeable components of the present disclosure.

SUMMARY

The present disclosure is directed to a bow making device with interchangeable components. In one embodiment, a bow making device kit includes a base assembly having a body component defining a needle mounting receptacle, a catch mounting receptacle, and fork mounting grooves in a top surface thereof. The bow making device kit could also include a needle assembly removably attachable to the needle mounting receptacle. The needle assembly could include a needle mount with a needle extending therefrom. The needle is vertically oriented when the needle assembly is attached to the needle mounting receptacle. The bow making device kit could also include a plurality of forks removably attachable to the fork mounting grooves. Each fork could have a base with a plurality of prongs extending therefrom. The plurality of forks circumscribe the needle assembly when the needle assembly and the plurality of forks are attached to the base assembly. The bow making device kit could also include a catch assembly removably attachable to the catch mounting receptacle. The catch assembly could have a plurality of fingers with movable inserts biased inwardly to contact each other.

In another embodiment, the bow making device includes a base assembly having a body component, a catch assembly for mounting to a top surface of the base assembly, a left pair of fingers having movable inserts biased inwardly to contact each other, and a right pair of fingers having movable inserts biased inwardly to contact each other. The catch assembly could have a plurality of upwardly extending fingers, the left pair of fingers adjacent to and separate from the right pair of fingers to receive ribbon therebetween.

In another embodiment, the bow making device includes a catch assembly for receiving and retaining ribbon during making of a bow. The catch assembly could have a first upwardly extending finger having a first insert with a male component proximate a top thereof and a second upwardly extending finger having a second insert with a female component proximate a top thereof. The first insert and the second insert could be biased inwardly to contact each other, such that the male component of the first insert engages the female component of the second insert when the first insert and the second insert contact each other.

In another embodiment, a method of using a bow making device includes puncturing ribbon with a needle of a needle assembly. The needle assembly is attached to a needle mounting receptacle of a base assembly. The method includes weaving an end of the ribbon around a prong of a plurality of forks circumscribing the needle assembly and back towards the needle assembly. Each fork has a base with a plurality of prongs extending therefrom, and each of the plurality of forks is attached to fork mounting grooves of the base assembly. The method includes again puncturing another section of the ribbon with the needle and repeating the steps of weaving and puncturing sections of the ribbon. Then the user threads string through an eye of the needle proximate a tip of the needle, and removes the ribbon woven in the bow design from the needle such that, as the ribbon is translated past the eye of the needle, the string is fed through the ribbon securing said sections.

BRIEF DESCRIPTION OF THE DRAWINGS

The foregoing features of the invention will be apparent from the following Detailed Description, taken in connection with the accompanying drawings, in which.

DETAILED DESCRIPTION

Disclosed herein is a bow making device. The bow making device facilitates the making of bows of various sizes and materials. The bow making device disclosed herein is comprehensive, robust, and transformable into different configurations for a variety of purposes. Further, the bow making device can be used to make bows of a variety of sizes and widths (e.g., ⅜in. to 6 inches wide) and types (e.g., hair, treetop, bridal, packaging, floral, etc.) using a variety of substrates (e.g., sheers, burlap, silk, satin, grosgrain, etc.), etc.

Figure 1:
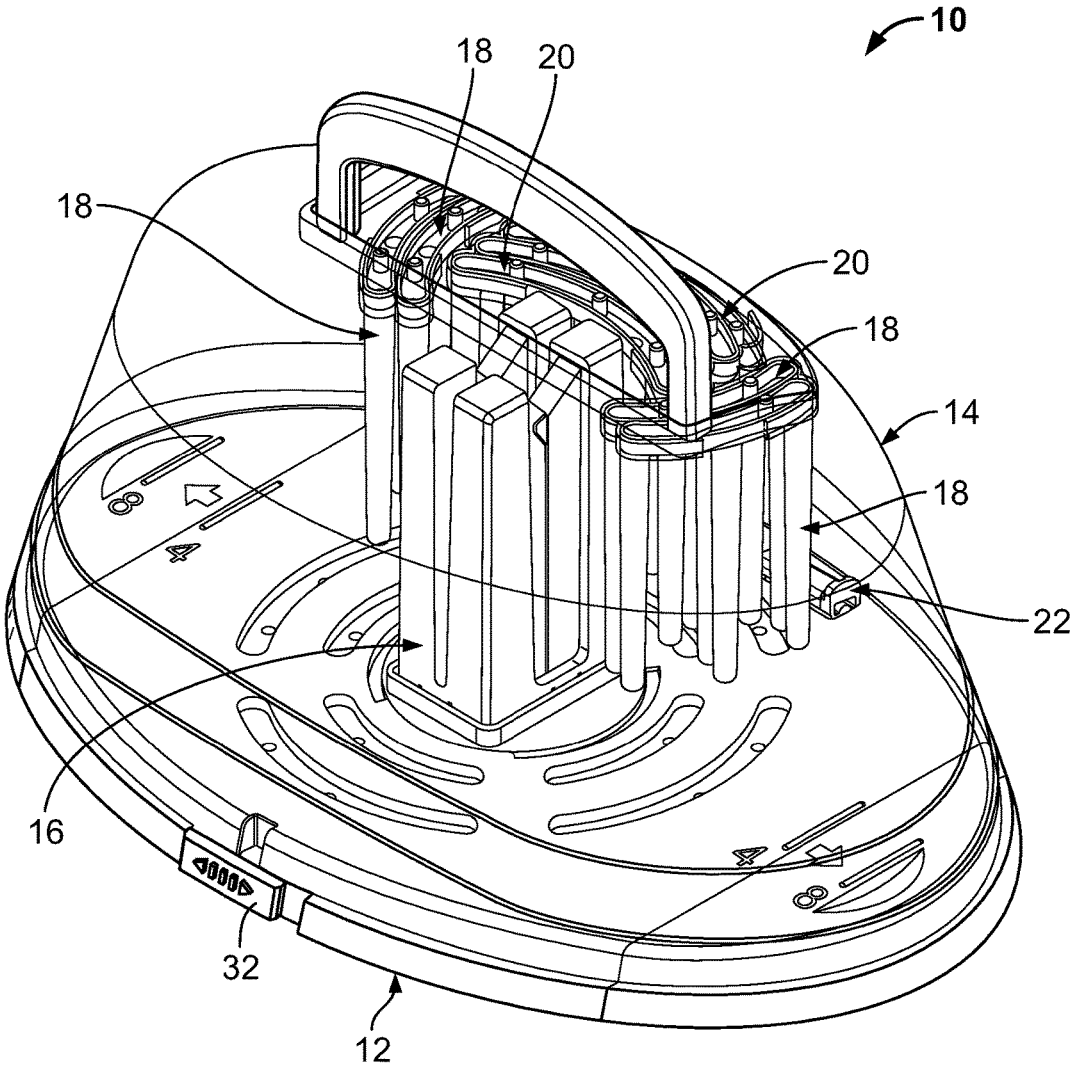
FIG. 1 is a front perspective view of a bow making device having a base assembly, a lid assembly, a catch assembly, a plurality of small forks, a plurality of large forks, and a needle assembly.

FIG. 1 is a front perspective view of a bow making device 10 with a transparent lid 128. The bow making device 10 includes a base assembly 12, a lid assembly 14, a catch assembly 16, a plurality of small forks 18, a plurality of large forks 20, and a needle assembly 22. As shown, and discussed below in more detail, the catch assembly 16 is attached to a top of the base assembly 12, and the needle assembly is removably housed within the base assembly 12 and accessible therefrom. The small forks 18 and large forks 20 are attached to an inside surface of the lid assembly 14 and depend therefrom. The lid assembly 14 is attached to the top of the base assembly 12 when the base assembly 12 is in a compact orientation (e.g., compact position, compact configuration, etc.) covering the catch assembly 18, the plurality of small forks 18, the plurality of large forks 20, and the needle assembly 22. Thus, the bow making device 10 and the various components thereof are compactly packaged for ease of transport and storage. Further, when the lid assembly 14 is attached to the base assembly 12, the small forks 18 and large forks 20 at least partially surround the left side, right side, and back side of the catch assembly 16. This way, when the switch 32 is slidably moved to the open position, the lid assembly 14 is disengaged and can be removed from the base assembly 12 by tilting the lid assembly 16 backward (so that the small forks 18 and large forks 20 clear the catch assembly 16).

Figure 2:
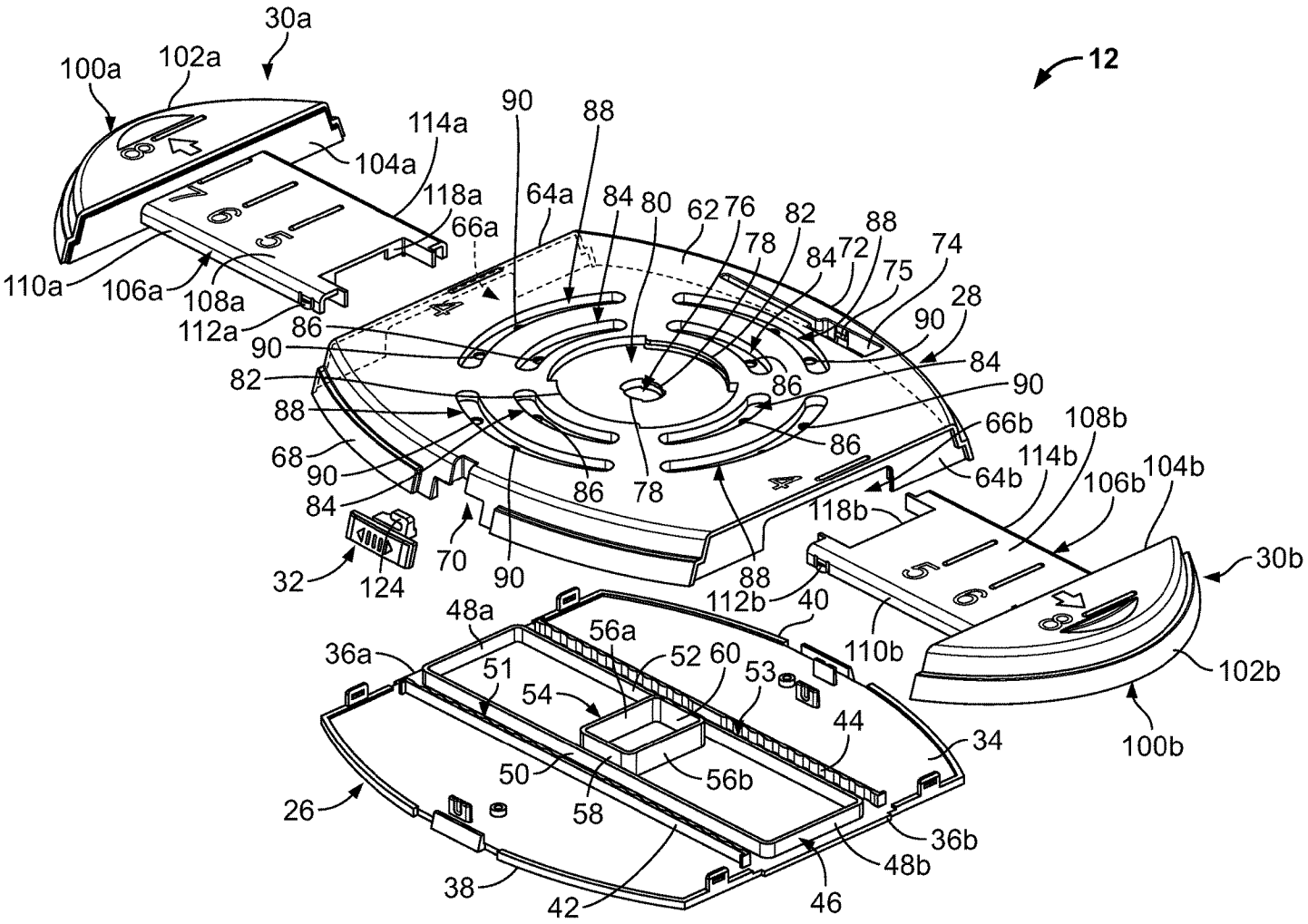
FIG. 2 is a an exploded front perspective view of the base assembly of FIG. 1.
Figure 3:
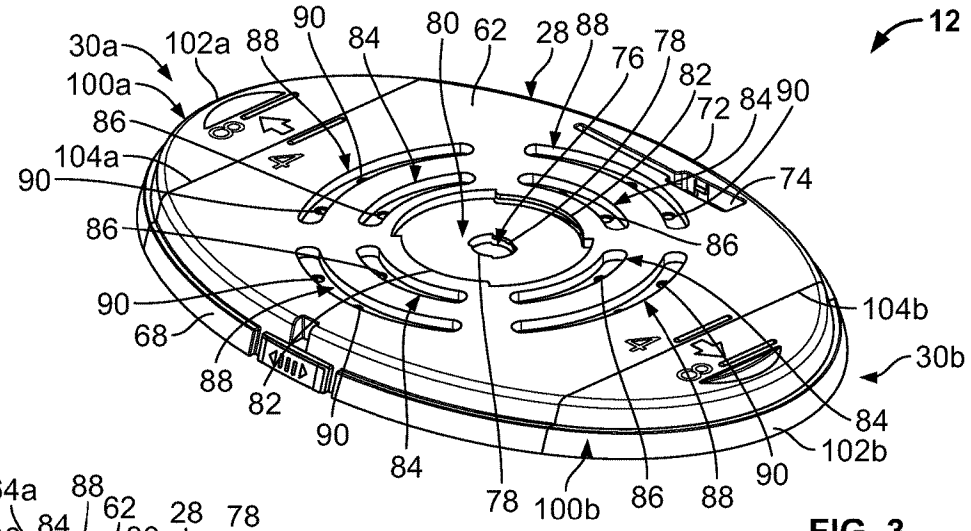
FIG. 3 is a front perspective view of the base assembly of FIG. 2 in a retracted orientation.
Figure 4:
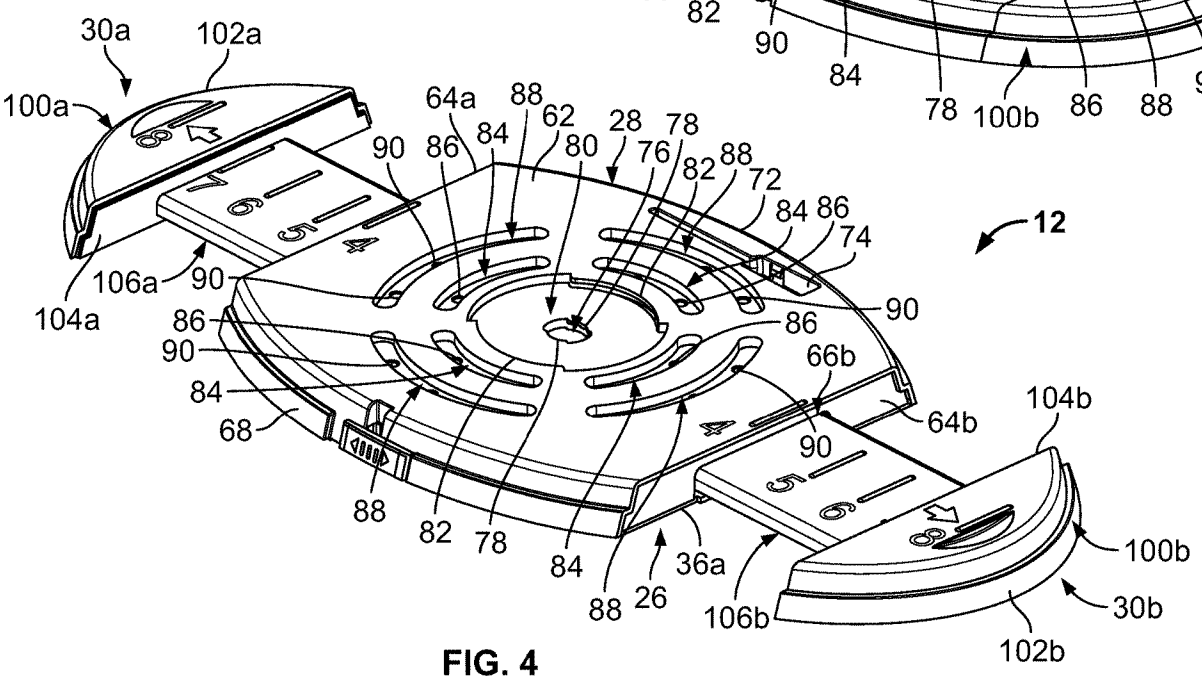
FIG. 4 is a front perspective view of the base assembly of FIG. 2 in an extended orientation.

FIGS. 2-4 are views of the bow maker base assembly 12 of FIG. 1. More specifically, FIG. 2 is an exploded front perspective view of the base assembly 12 of FIG. 1, FIG. 3 is a front perspective view of the base assembly 12 of FIG. 2 in a compact orientation, and FIG. 4 is a front perspective view of the base assembly 12 of FIG. 2 in an extended orientation. The base assembly 12 provides a modular workstation to facilitate easy and efficient bow making. In particular, the base assembly 12 houses and mounts various bow making components. For example, the base assembly 12 retains the needle assembly 22 therein and provides a foundation to interchangeably mount the catch assembly 16, the plurality of small forks 18, and the plurality of large forks 20. Further, the base assembly 12 has a left retractable arm 30*a* and a right retractable arm 30*b* movable from a compact orientation for transport and storage to an extended orientation for ease of measurement (e.g., of ribbon, string, wire, etc.).

The base assembly 12 includes a lower body component 26, an upper body component 28, a left retractable arm 30*a*, a right retractable arm 30*b*, and a switch 32. The lower body component 26 has a bottom wall 34 with a left peripheral edge 36*a*, a right peripheral edge 36*b* opposite to the left peripheral edge 36*a*, an arced front peripheral edge 38, and an arced back peripheral edge 40 opposite the arced front peripheral edge 38. The peripheral edges of the bottom wall 34 could include a lip and/or engagement structures to attach the lower body component 26 to the upper body component 28.

The lower body component 26 also includes a front track wall 42 and a back track wall 44, each extending from a top surface of the bottom wall 34. As discussed herein, the front track wall 42 and back track wall 44 provide a track for the left retractable arm 30*a* and the right retractable arm 30*b* to move along. The length of each of the front track wall 42 and the back track wall 44 extend from the bottom wall left peripheral edge 36*a* to the bottom wall right peripheral edge 36*b*. The front track wall 42 is disposed towards the arced front peripheral edge 38, and the back track wall 44 is disposed towards the arced back peripheral edge 40. The surface of the front track wall 42 closest to the center of the lower body component 26 is scalloped (e.g., a series of curved projections). Similarly, the surface of the back track wall 44 closest to the center of the lower body component 26 is also scalloped. In other words, the scalloped wall surfaces of the front track wall 42 and the back track wall 44 face each other.

The lower body component 28 further includes a rectangularly shaped track fence 46 extending from the top surface of the bottom wall 34 and positioned between the front track wall 42 and the back track wall 44. The track fence 46, along with the front track wall 42 and back track wall 44, define a track (e.g., slot) for the left retractable arm 30*a* and the right retractable arm 30*b* to move along, and provide stability and support for such movement. The length of the track fence 46 approximately extends from the left peripheral edge 36*a* to the right peripheral edge 36*b*, and the width of the track fence 43 approximately extends from the front track wall 42 to the back track wall 44. More specifically, the track fence 46 includes a track fence left side 48*a* positioned adjacent to the bottom wall left peripheral edge 36*a*, a track fence right side 48*b* positioned adjacent to the bottom wall right peripheral edge 36*b*, a track fence front side 50 disposed towards the bottom wall arced front peripheral edge 38 adjacent to the scalloped surface of the front track wall 42, and a track fence back side 52 disposed towards the bottom wall arced back peripheral edge 40 adjacent to the scalloped surface of the back track wall 44. Accordingly, a first track (e.g., front track) is formed between the track fence front side 50 and the scalloped surface of the front track wall 42. A second track (e.g., back track) is formed between the track fence back side 52 and the scalloped surface of the back track wall 44.

The lower body component also includes a rectangularly shaped stop fence 54 attached to the top surface of the bottom wall 34 and positioned within the track fence 46. The stop fence 54 provides an inner limit on how far into the interior of the base assembly 12 the left retractable arm 30*a* and the right retractable arm 30*b* can retract. The length of the stop fence 54 extends from approximately the track fence front side 50 to approximately the track fence back side 52. More specifically, the stop fence 54 includes a track fence left side 56*a* disposed towards the bottom wall left peripheral edge 36*a*, a stop fence right side 56*b* disposed towards the bottom wall right peripheral edge 36*b*, a stop fence front side 58 disposed towards the bottom wall arced front peripheral edge 38 approximately adjacent the track fence front side 50, and a stop fence back side 60 disposed towards the bottom wall arced back peripheral edge 40 approximately adjacent the track fence back side 52.

The upper body component 28 has a top surface with a number of grooves and mounting receptacles to interchangeably mount various bow making components, and the upper body component 28 attaches to the lower body component 26 to movably attach the left retractable arm 30*a* and the right retractable arm 30*b*. The upper body component 28 includes a top wall 62 with a left wall 64*a*, right wall 64*b*, arced front wall 68 and arced back wall 72 depending therefrom. The left wall 64*a* defines an arm opening 66*a* and the right wall 64*b* defines an arm opening 66*b*. The arced front wall 68 defines a switch aperture 70.

Defined in the top wall 62, proximate the upper body component arced back wall 72, is a needle assembly holder 74 to releasably house and engage the needle assembly 22 for storage. More specifically, the needle assembly holder 74 is shaped in the profile of the needle assembly 22 so that the needle assembly 22 is laid horizontally in the upper body component 28 and could be approximately flush with the upper body component top wall 62. The needle assembly holder 74 could include one or more hinged protrusions 75 biased inwardly to engage one or more grooves in the needle assembly 22 to retain the needle assembly 22 in the needle assembly holder 74.

In some embodiments, defined at the approximate center of the upper body component 28 is a needle mounting receptacle 76 having needle retaining shelves 78 (to receive and removably secure the needle assembly 22) and the catch mounting receptacle 80 having catch retaining shelves 82 (to receive and removably secure the catch assembly 16 (e.g., in a tongue and groove fashion, in a bayonet mount, in a twist lock fashion, etc.)). The needle mounting receptacle 76 receives the needle assembly therein so that a user can puncture a ribbon (e.g., at one or more points along its length) to secure ribbon placement to facilitate making of a bow. The catch mounting receptacle 80 receives the catch assembly therein so that a user can weave ribbon around and through the catch assembly to secure ribbon placement to facilitate making of a bow.

The needle mounting receptacle 76 and catch mounting receptacle 80 are generally circularly shaped, and the needle mounting receptacle 76 is positioned within and at an approximate center of the catch mounting receptacle 80. Accordingly, the catch mounting receptacle 80 depends downwardly from a top surface of the upper body component top wall 62, and the needle mounting receptacle 76 depends downwardly from a bottom surface of the catch mounting receptacle 80.

There are two generally curved needle retaining shelves 78 (although any number of shelves could be used) that are positioned opposite one another and extend inwardly (e.g., toward one another) from a top surface of the needle mounting receptacle 76 (e.g., the bottom surface of the catch mounting receptacle 80), such that there is a space between the bottom surface of the needle retaining shelves 78 and a bottom surface of the needle mounting receptacle 76. More specifically, a first needle retaining shelf 78 could extend inwardly from a peripheral edge of the needle mounting receptacle 76 and be disposed towards the upper body component arced front wall 68, a second needle retaining shelf 78 could extend inwardly from the peripheral edge of the needle mounting receptacle 76 and be disposed towards the upper body component arced back wall 72. Accordingly, the distance between the needle retaining shelves 78 is less than the diameter of the needle mounting receptacle 76.

Similarly, there are two generally curved catch retaining shelves 82 (although any number of shelves could be used) that are positioned opposite one another and extend inwardly (e.g., toward one another) from a top surface of the catch mounting receptacle 80 (e.g., a top surface of the upper body component top wall 62), such that there is a space between the bottom surface of the catch retaining shelves 82 and a bottom surface of the catch mounting receptacle 80. More specifically, a first catch retaining shelf 82 could extend inwardly from a peripheral edge of the catch mounting receptacle 80 and be disposed towards the upper body component arced front wall 68, a second catch retaining shelf 82 could extend inwardly from the peripheral edge of the catch mounting receptacle 80 and be disposed towards the upper body component arced back wall 72. Accordingly, the distance between the catch retaining shelves 82 is less than the diameter of the catch mounting receptacle 80.

The upper body component 28 further includes small fork mounting grooves 84 (to removably receive and secure small forks 18) and large fork mounting grooves 88 (to removably receive and secure large forks 20) defined in the upper body component top wall 62. The small fork mounting grooves 84 receive a small fork 18 and large fork mounting grooves 88 receive a large fork 20. The forks (e.g., small forks 18, large forks 20) each have a plurality of prongs which, when mounted to the base assembly 12, circumscribe the needle assembly 22. In this way, a user can weave ribbon around prongs of the forks (e.g., small forks 18, large forks 20) and with each pass puncture a needle of the needle assembly 22 to make a variety of types and sizes of bows.

The small fork mounting grooves 84 and the large fork mounting grooves 88 in a general arc shape. The small fork mounting grooves 84 are positioned annularly around the catch mounting receptacle 80 (and as a result the small fork mounting grooves 84 are also positioned annularly around the needle mounting receptacle 76) and could have one or more small arced groove mounting holes 86 positioned therein. More specifically, there could be four small fork mounting grooves 84, where a first small arced groove 84 is positioned toward the upper body component left wall 64*a*, a second small arced groove 84 is positioned toward the upper body component right wall 64*b*, a third small arced groove 84 is positioned toward the upper body component arced front wall 68, and a fourth small arced groove 84 is positioned toward the upper body component arced back wall 72. The four small fork mounting grooves 84 form a generally circular shape. However, the mounting grooves 88 could be of any other suitable shape, such as depending on aesthetic desires.

Similarly, the large fork mounting grooves 88 are positioned annularly around the catch mounting receptacle 80 (and as a result the large fork mounting grooves 88 are also positioned annularly around the needle mounting receptacle 76) and could have one or more large arced groove mounting holes 90 positioned therein. More specifically, there could be four large fork mounting grooves 88, where a first large arced groove 88 is positioned toward the upper body component left wall 64*a*, a second large arced groove 88 is positioned toward the upper body component right wall 64*b*, a third large arced groove 88 is positioned toward the upper body component arced front wall 68, and a fourth large arced groove 88 is positioned toward the upper body component arced back wall 72. The four large fork mounting grooves 88 forming a generally circular shape. However, the mounting grooves 88 could be of any other suitable shape, such as depending on aesthetic desires.

Accordingly, the small fork mounting grooves 84 and large fork mounting grooves 88 are concentric and circumferentially aligned with one another. However, any suitable configuration is possible, such as depending on the shape of the bases of the forks and/or aesthetic desires. For example, the small fork mounting grooves 84 and large fork mounting grooves 88 could be triangularly shaped (instead of arced), triangularly positioned (instead of radially spaced), and/or the small fork mounting grooves 84 could be misaligned with the large fork mounting grooves 88.

The left retractable arm 30*a* and right retractable arm 30*b* are used with the upper body component 28 to form a ruler when the left retractable arm 30*a* and the right retractable arm 30*b* are in an extended position. This facilitates measurement of ribbon during bow making using either the catch assembly 16 or the needle assembly 22 and plurality of forks (e.g., small forks 18, large forks 20).

The left retractable arm 30*a* includes a left handle portion 100*a* and a left ruler portion 106*a*. The left handle portion 100*a* has an arced side 102*a* and a flat side 104*a*, where the left ruler portion 106*a* extends from the flat side 104*a* of the left handle portion 100*a*. The left ruler portion 106*a* includes a left arm top wall 108*a* with a left arm front wall 110*a* and a left arm back wall 114*a* depending therefrom (the left arm front wall 110*a* opposite the left arm back wall 114*a*). Further, a left track engagement protrusion 112*a* extends from an external surface of the left arm front wall 110*a* at an end opposite from the left handle portion 110*a*, and a left track engagement protrusion 112*a* extends from an external surface of the left arm back wall 114*a* at an end opposite from the left handle portion 110*a* (not shown).

The left retractable arm 30*a* further includes a left arm retaining wall 118*a* depending from the left arm top wall 110*a* at an end opposite from the left handle portion 110*a* and between the left arm front wall 110*a* and the left arm back wall 114*a*. The ends of the left arm front wall 110*a* and the left arm back wall 114*a* could extend past the left arm retaining wall 118*a*, such that the distance of the left arm retaining wall 118*a* to the left handle portion 110*a* is less than the distance of the ends of the left arm front wall 110*a* and left arm back wall 114*a* to the left handle portion 110*a* (e.g., the track engagement protrusion 112*a* is farther from the left handle portion 110*a* than the left arm retaining wall 118*a*).

When assembled (as shown in FIG. 4), the left retractable arm 30*a* is positioned in the upper body component left wall arm opening 66*a* between the base assembly lower body component 26 and the base assembly upper body component 28. More specifically, the left retractable arm front wall 110*a* is positioned in the first track 51 between the lower body component front track wall 42 and the lower body component track fence front side 50, and the left retractable arm back wall 114*a* is positioned in the second track 53 between the lower body component back track wall 44 and the lower body component track fence back side 60. Accordingly, the left retractable arm front wall track engagement protrusion 112*a* engages the scalloped surface of the lower body component front track wall 42, and the left retractable arm back wall track engagement protrusion 112*a* engages the scalloped surface of the lower body component back track wall 44. This provides slidable movement of the left retractable arm 30*a* relative to the lower body component 26 and the upper body component 28 and clicks into one of a plurality of positions (due to the track engagement protrusions 112*a* engaging and disengaging the scalloped surface of the lower body component front track wall 42 and the lower body component back track wall 44).

Further, when the left retractable arm 30*a* is assembled to the lower body component 26, the left retractable arm ruler portion retaining wall 118*a* is positioned between the lower body component track fence left side 48*a* and the lower body component stop fence left side 56*a*, and movable therebetween (as the left retractable arm 30*a* slidably moves relative to the lower body component 26 and the upper body component 28). The left retractable arm ruler portion retaining wall 118*a* prevents the left retractable arm 30*a* from sliding too far out of the lower body component 26 and upper body component 28 and disengaging therefrom. The left retractable arm ruler portion front wall 110*a* and left retractable arm ruler portion back wall 114*a* extend past the left retractable arm ruler portion retaining wall 118*a* to provide pivotal support when the left retractable arm 30*a* is at full extension. In other words, when at full extension, the left retractable arm 30*a* cannot accidentally pivotally disengage from the lower body component 26 and the upper body component 28 in some embodiments. The left retractable arm ruler portion retaining wall 118*a* could contact the lower body component stop fence left side 56*a* to prevent the left retractable arm 30*a* from retracting too far into the lower body component 26 and the upper body component 28 (e.g., if the upper component left wall 64*a* is not provided).

The right retractable arm 30*b* includes a right handle portion 100*b* and a right ruler portion 106*b*. The right handle portion 100*b* has an arced side 102*b* and a flat side 104*b*, where the right ruler portion 106*b* extends from the flat side 104*b* of the right handle portion 100*b*. The right ruler portion 106*b* includes a right arm top wall 108*b* with a right arm front wall 110*b* and a right arm back wall 114*b* depending therefrom (the right arm front wall 110*b* opposite the right arm back wall 114*b*). Further, a right track engagement protrusion 112*b* extends from an external surface of the right arm front wall 110*b* at an end opposite from the right handle portion 110*b*, and a right track engagement protrusion 112*b* extends from an external surface of the right arm back wall 114*b* at an end opposite from the right handle portion 110*b* (not shown).

The right retractable arm 30*b* further includes a right arm retaining wall 118*b* depending from the right arm top wall 110*b* at an end opposite from the right handle portion 110*b* and between the right arm front wall 110*b* and the right arm back wall 114*b*. The ends of the right arm front wall 110*b* and the right arm back wall 114*b* could extend past the right arm retaining wall 118*b*, such that the distance of the right arm retaining wall 118*b* to the right handle portion 110*b* is less than the distance of the ends of the right arm front wall 110*b* and right arm back wall 114*b* to the right handle portion 110*b* (e.g., the track engagement protrusion 112*b* is farther from the right handle portion 110*b* than the right arm retaining wall 118*b*).

When assembled (as shown in FIG. 4), the right retractable arm 30*b* is positioned in the upper body component right wall arm opening 66*b* between the base assembly lower body component 26 and the base assembly upper body component 28. More specifically, the right retractable arm front wall 110*a* is positioned in the first track 51 between the lower body component front track wall 42 and the lower body component track fence front side 50, and the right retractable arm back wall 114*b* is positioned in the second track 53 between the lower body component back track wall 44 and the lower body component track fence back side 60. Accordingly, the right retractable arm front wall track engagement protrusion 112*b* engages the scalloped surface of the lower body component front track wall 42, and the right retractable arm back wall track engagement protrusion 112*b* engages the scalloped surface of the lower body component back track wall 44. This provides slidable movement of the right retractable arm 30*b* relative to the lower body component 26 and the upper body component 28 and clicks into one of a plurality of positions (due to the track engagement protrusions 112*b* engaging and disengaging the scalloped surface of the lower body component front track wall 42 and the lower body component back track wall 44).

Further, when the right retractable arm 30*b* is assembled to the lower body component 26, the right retractable arm ruler portion retaining wall 118*b* is positioned between the lower body component track fence right side 48*b* and the lower body component stop fence right side 56*b*, and movable therebetween (as the right retractable arm 30*b* slidably moves relative to the lower body component 26 and the upper body component 28). The right retractable arm ruler portion retaining wall 118*b* prevents the right retractable arm 30*b* from sliding too far out of the lower body component 26 and upper body component 28 and disengaging therefrom. The right retractable arm ruler portion front wall 110*b* and right retractable arm ruler portion back wall 114*b* extend past the right retractable arm ruler portion retaining wall 118*b* to provide pivotal support when the right retractable arm 30*b* is at full extension. In other words, when at full extension, the right retractable arm 30*b* cannot accidentally pivotally disengage from the lower body component 26 and the upper body component 28. The right retractable arm ruler portion retaining wall 118*b* could contact the lower body component stop fence right side 56*b* to prevent the right retractable arm 30*b* from retracting too far into the lower body component 26 and the upper body component 28 (e.g., if the upper component right wall 64*b* is not provided).

The switch 32 engages and secures the lid assembly 14 to the base assembly 12. The switch 32 could include a hook 124 extending from a top portion thereof. The switch 32 could be mounted in the upper body component arced front wall switch aperture 70 and move horizontally from a first position to a second position. The switch in the first position engages the lid assembly 14 and secures the lid assembly 14 to the base assembly 12. The switch in the second position disengages the lid assembly 14 and releases the lid assembly 14 from the base assembly 12.

As shown in FIG. 3, when the left retractable arm 30*a* and the right retractable arm 30*b* are in a compact orientation, the left retractable arm handle portion arced side 102*a* aligns with the upper body component arced front wall 68 and the arced back wall 72, and the right retractable arm handle portion arced side 102*b* aligns with the upper body component arced front wall 68 and the arced back wall 72. Accordingly, when the left retractable arm 30*a* and the right retractable arm 30*b* are in a compact orientation, the left retractable arm 30*a*, the right retractable arm 30*b*, and the upper body component 28 form a generally oval shape.

As shown in FIG. 4, when the left retractable arm 30*a* and the right retractable arm 30*b* are in an extended position, the left retractable arm 30*a*, right retractable arm 30*b*, and upper body component 28 form a ruler. More specifically, the top surface of the left retractable arm handle portion 100*a*, the top surface of the left retractable arm ruler portion 106*a*, the top surface of the left retractable arm handle portion 100*b*, the top surface of the left retractable arm ruler portion 106*b*, and/or the top surface of the upper body component top wall 62 could include indicia (e.g., numbered indicia). The indicia could correspond with a distance (e.g., in English or metric units) from the center of the base assembly 12, for example. In this way, a user could easily measure ribbon, string, wire, and/or other ribbon material that used to make a bow with the bow making device 10.

Figure 5:
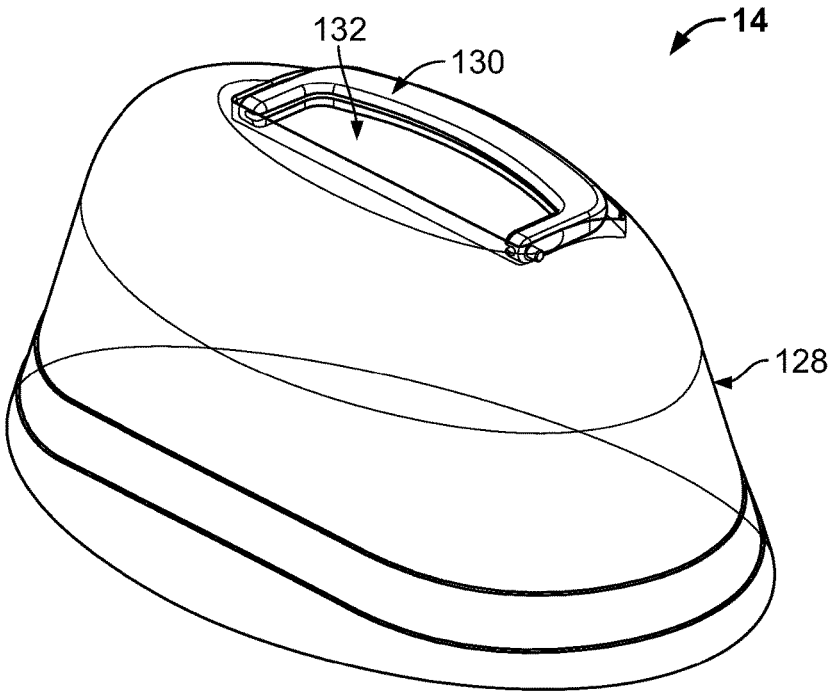
FIG. 5 is a front perspective view of the lid assembly of FIG. 1.
Figure 6:
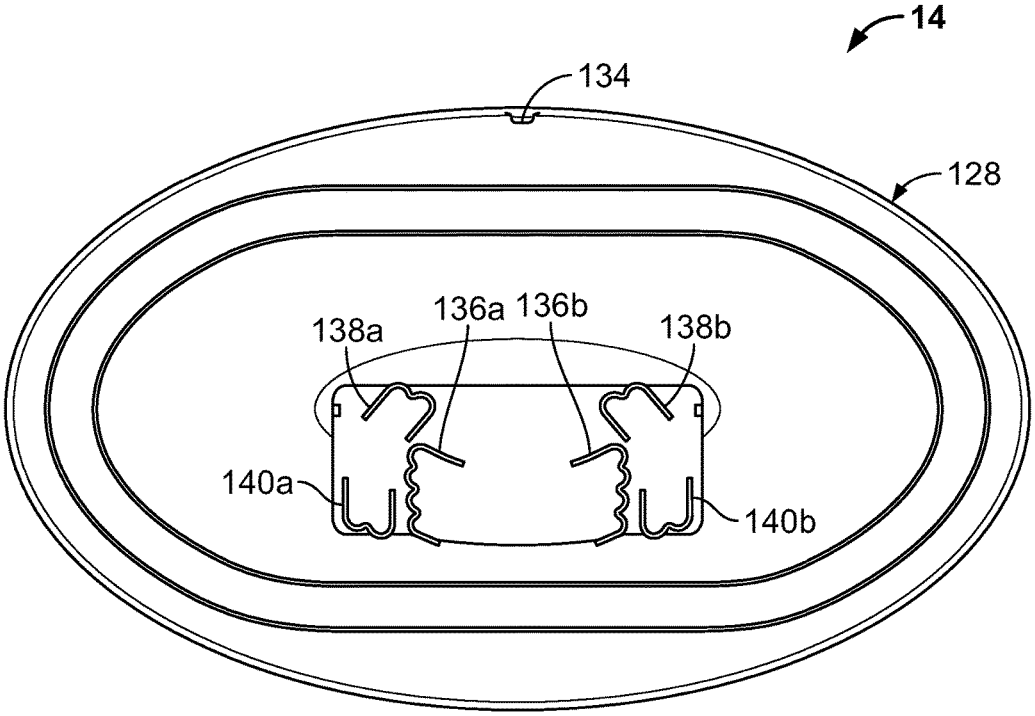
FIG. 6 is a bottom view of the lid assembly of FIG. 5.

FIGS. 5-6 are views of the bow maker lid assembly 14. More specifically, FIG. 5 is a front perspective view of the lid assembly 14 of FIG. 1, and FIG. 6 is a bottom view of the lid assembly 14 of FIG. 5. The lid assembly 14 includes a lid 128 and a handle 130. The bow maker lid assembly 14 attaches to the base assembly 12 to enclose the components of the bow making device 10 for ease of storage and transportation (e.g., such that the entire bow making device 10 can be transported by use of the handle 130).

The lid 128 has a generally oval base that generally conforms to the oval shape of the base assembly upper body component 26, base assembly left retractable arm 30*a*, and base assembly right retractable arm 30*b* when the left retractable arm 30*a* and the right retractable arm 30*b* are in the compact orientation (as in FIGS. 1 and 3). The lid 128 further includes a handle recess 132 at a top of the lid and a switch engagement protrusion 134 extending inwardly from a lip of the lid 128. The switch engagement protrusion 134 is positioned to correspond with the position of the base assembly switch 32 in the base assembly upper body component arced front wall switch aperture 70. Accordingly, the base assembly switch hook 124 slidably engages with the lid switch engagement protrusion 134 to releasably secure the lid assembly 128 to the base assembly 12.

The lid 128 further includes a number of engagement segments depending from a top interior of the lid 128. More specifically, the lid 128 includes a left large fork engagement segment 136*a* and a right large fork engagement segment 136*b*. The left large fork engagement segment 136*a* and the right large fork engagement segment 136*b* receive and secure the plurality of large forks 20 therebetween to store the plurality of large forks 20 within the lid assembly 14. The left large fork engagement segment 136*a* is positioned towards a back left of the lid 128, and the right large fork engagement segment 136*b* is positioned towards a back right of the lid 128. The left large fork engagement segment 136*a* includes one or more bulges and the right large fork engagement segment 136*b* includes one or more bulges. The bulges of the left large fork engagement segment 136*a* align with the bulges right large fork engagement segment 136*b* and are shaped to conform to at least a portion of (e.g., ends of) a large fork 20 such that each pair of bulges releasably receives a large fork 20 therebetween. For example, the left large fork engagement segment 136*a* and the right large fork engagement segment 136*b* each have four bulges, such that the segments can receive and secure four large forks 20 (e.g., secured by frictional engagement). In this way, the large forks 20 will suspend downwardly from the interior top of the lid 128 when secured thereto.

The lid 128 includes a left front small fork engagement segment 138*a*, left back small fork engagement segment 140*a*, right front small fork engagement segment 138*b*, and a right back small fork engagement segment 140*b* which receive and secure the plurality of small forks 18 therebetween to store the plurality of small forks 18 within the lid assembly 14. The left front small fork engagement segment 138*a* and the left back small fork engagement segment 140*a* are positioned towards a left side of the lid 128 (further left than the left large fork engagement segment 136*a*), with left front small fork engagement segment 138*a* positioned close to the front than the left back small fork engagement segment 140*a*. The left front small fork engagement segment 138*a* includes one or more bulges and the left back small fork engagement segment 140*a* includes one or more bulges. The bulges of the left front small fork engagement segment 138*a* align with the bulges of the left back small fork engagement segment 140*a* and are shaped to conform to at least a portion of (e.g., ends of) a small fork 18 such that each pair of bulges releasably receives a small fork 18 therebetween. For example, left front small fork engagement segment 138*a* and the left back small fork engagement segment 140*a* each have two bulges, such that the segments can receive and secure two small forks 18 (e.g., secured by frictional engagement). In this way, the small forks 18 will suspend downwardly from the interior top of the lid 128 when secured thereto.

Similarly, the right front small fork engagement segment 138*b* and the right back small fork engagement segment 140*b* are positioned towards a right side of the lid 128 (further right than the right large fork engagement segment 136*b*), with right front small fork engagement segment 138*b* positioned close to the front than the right back small fork engagement segment 140*b*. The right front small fork engagement segment 138*b* includes one or more bulges and the right back small fork engagement segment 140*b* includes one or more bulges. The bulges of the right front small fork engagement segment 138*b* align with the bulges of the right back small fork engagement segment 140*b* and are shaped to conform to at least a portion of (e.g., ends of) a small fork 18 such that each pair of bulges releasably receives a small fork 18 therebetween. For example, right front small fork engagement segment 138*b* and the right back small fork engagement segment 140*b* each have two bulges, such that the segments can receive and secure two small forks 18 (e.g., secured by frictional engagement). In this way, the small forks 18 will suspend downwardly from the interior top of the lid 128 when secured thereto.

Figure 7:
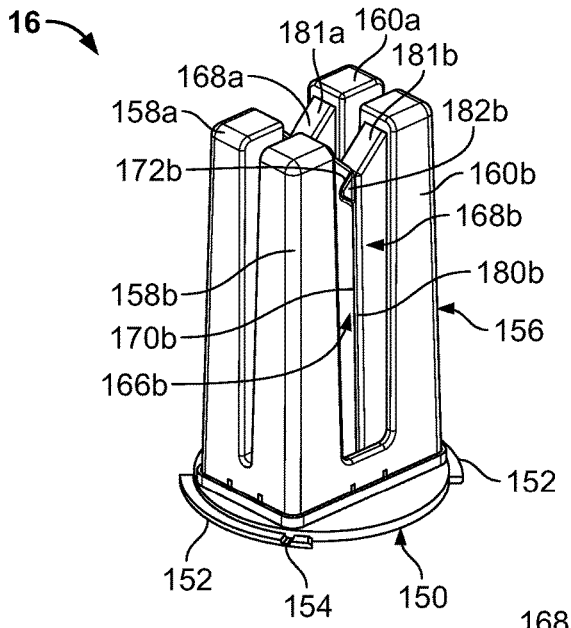
FIG. 7 is a front perspective view of a catch assembly of FIG. 1.
Figure 8:
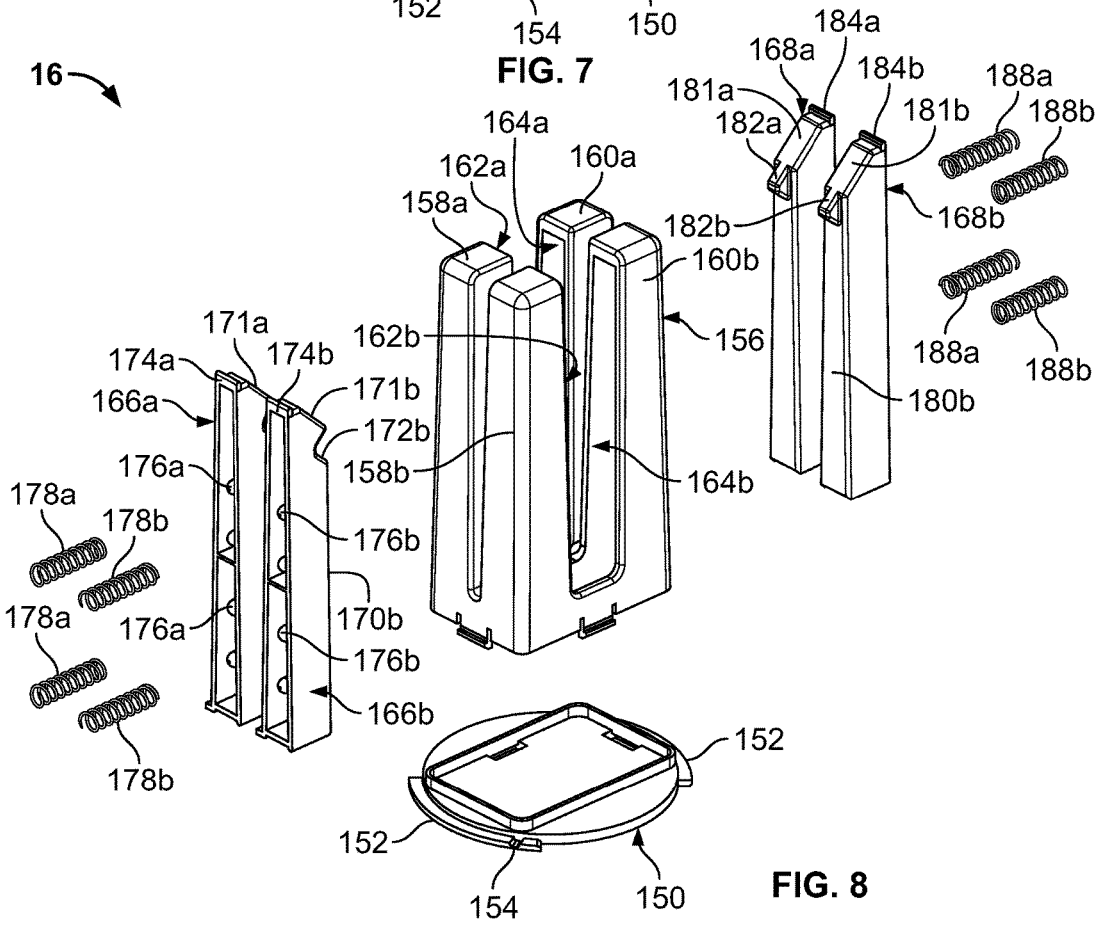
FIG. 8 is an exploded perspective view of the catch assembly of FIG. 7.
Figure 10:
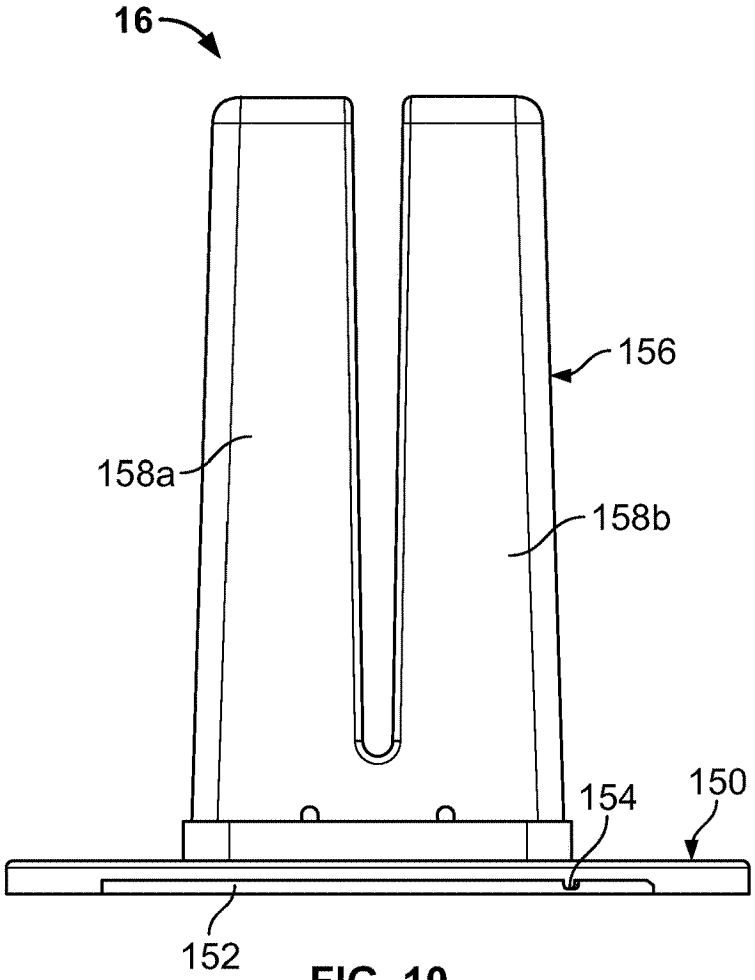
FIG. 10 is a side elevation view of the catch assembly of FIG. 7.
Figure 9:
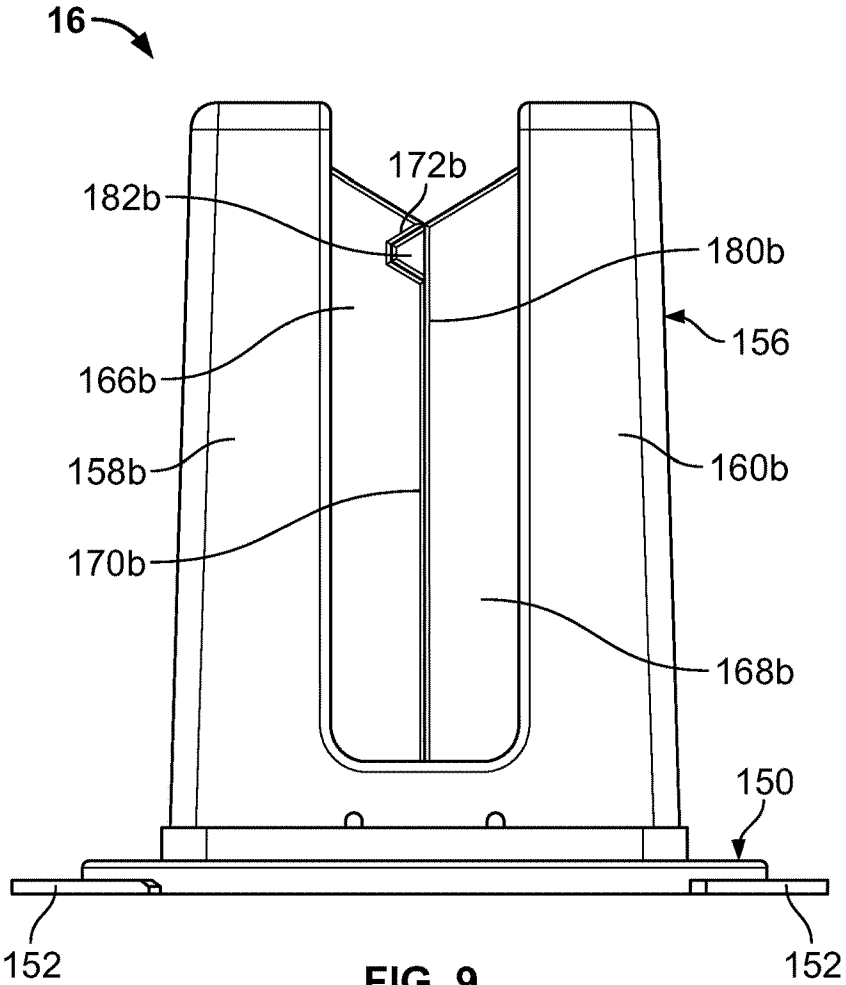
FIG. 9 is a front elevation view of the catch assembly of FIG. 7.

FIGS. 7-10 are views of the catch assembly 16 of the bow making device 10. More specifically, FIG. 7 is a front perspective view of a catch assembly 16 of FIG. 1, FIG. 8 is an exploded perspective view of the catch assembly 16 of FIG. 7, FIG. 9 is a front plan view of the catch assembly 16 of FIG. 7, and FIG. 10 is a side plan view of the catch assembly 16 of FIG. 7. The catch assembly 16 can be releasably attached to the base assembly 12 so that a user can use the catch assembly 16 to wrap and hold portions of ribbon, string, wire, etc. to make a bow.

The catch assembly 16 includes a catch base 150 having one or more flanges 152 extending outwardly therefrom, at least one of the flanges 152 could have a dimple 154 on a top surface thereof. More specifically, the catch base 150 could be circularly shaped and could have a first flange 152 extending from a front of the catch assembly 16 and a second flange 152 extending from a back of the catch assembly 16 (in a direction opposite to the first base). The diameter of the catch base 150 is less than the distance between the base assembly upper body component catch retaining shelves 82, and the distance from the ends of the first and second flanges 152 is more than the distance between the base assembly upper body component catch retaining shelves 82 but less than the diameter of the base assembly upper body component catch mounting receptacle 80. Accordingly, the catch base 150 can be inserted into the catch mounting receptacle 80 in a first orientation (e.g., unlocked orientation) where no portion of the catch base flanges 152 align with the base assembly upper body component catch retaining shelves 82. Once inserted, the catch base 150 can be rotated to a second orientation (e.g., locked orientation) where at least a portion of the catch base flanges 152 align with the base assembly upper body component catch retaining shelves 82, thereby securing the catch base assembly 16 to the base assembly 12. Further, a protrusion on a lower surface of one of the base assembly upper body component catch retaining shelves 82 could removably engage the catch base dimple 154 when oriented to the second orientation, thereby providing tactile feedback for a user as to when the catch base 150 is properly oriented and secured within the base assembly upper body component catch mounting receptacle 80, and also rotationally securing the catch assembly 16.

A catch body 156 is fixedly mounted to a top surface of the catch base 150, such as by insertion of hinged protrusions (e.g., biased outwardly) of the catch body 156 into recesses in the catch base 150. The catch body 156 includes a plurality of upwardly extending catch fingers, each generally rectangularly shaped (but could be of any shape). More specifically, the catch body 156 includes a front left catch finger 158*a*, a front right catch finger 158*b*, a back left catch finger 160*a*, and a back right catch finger 160*b* extending upwardly with a space therebetween (e.g., except at the bottom thereof, where the fingers could be connected to one another). The distance between the front left catch finger 158*a* and the front right catch finger 158*b* could be the same distance as that between the back left catch finger 160*a* and the back right catch finger 160*b*. The distance between the front left catch finger 158*a* and the back left catch finger 160*a* could be the same as the distance between the front right catch finger 158*b* and the back right catch finger 160*b*. The distance between the front left catch finger 158*a* and the front right catch finger 158*b* could be less than the distance between the front left catch finger 158*a* and the back left catch finger 160*a* and less than the distance between the front right catch finger 158*b* and the back right catch finger 160*b*.

The front left catch finger 158*a* defines a recess opening 162*a* in a back surface thereof. The front right catch finger 158*b* defines a recess opening 162*b* in a back surface thereof. The back left catch finger 160*a* defines a recess opening 164*a* in a front surface thereof. The back right catch finger 160*b* defines a recess opening 164*b* in a front surface thereof. Accordingly, the front left catch finger recess opening 162*a* and the back left catch finger recess opening 164*a* face each other, and the front right catch finger recess opening 162*b* and the back right catch finger recess opening 164*b* face each other. The catch fingers allow a user to weave ribbon, string, wire, etc. therebetween to secure placement thereof in making a bow.

The catch assembly 16 further comprises a left female insert 166*a*, a right female insert 166*b*, a left male insert 168*a*, and a right male insert 168*b*. The inserts are inwardly biased to secure ribbon as portions of the ribbon are placed therebetween to secure placement thereof in making a bow. The inserts also include mating components to secure the ribbon between the inwardly biased inserts and prevent accidental disengagement of the ribbon from the catch assembly 16.

The left female insert 166*a* is inserted into the front left catch finger 158*a*, and as a result is generally rectangularly shaped and generally corresponds in shape to that of the front left catch finger 158*a*. The left female insert 166*a* includes a mating surface 170*a* and a sloped surface 171*a* at an approximate top of the left female insert 166*a* (e.g., the mating surface 170*a* and the sloped surface 171*a* forming an angle relative to one another). At the approximate intersection of the mating surface 170*a* and sloped surface 171*a* is a female mating component 172*a* (e.g., a notch). At an opposite end of the sloped surface 171*a* is a retaining flange 174*a*. When the left female insert 166*a* is inserted in the front left catch finger recess opening 162*a*, the left female insert retaining flange 174*a* engages a lip of the front left catch finger recess opening 162*a* thereby preventing the left female insert 166*a* from disengaging from the left catch finger recess opening 162*a* (e.g., the distance from the bottom of the left female insert 166*a* to the top of the retaining flange 174*a* is greater than the distance from the bottom of the front left catch finger recess opening 162*a* to the top of the front left catch finger recess opening 162*a*). Spring mounts 176*a* extend from an inner surface of the left female insert 166*a* (e.g., an inside surface opposite the mating surface 170*a*). One or more springs 178*a* are mounted to the spring mounts 176*a* to bias the left female insert 166*a* towards a center of the catch body 156 when inserted into the front left catch finger 158*a*.

Similarly, the right female insert 166*b* is inserted into the front right catch finger 158*b*, and as a result is generally rectangularly shaped and generally corresponds in shape to that of the front right catch finger 158*b*. The right female insert 166*b* includes a mating surface 170*b* and a sloped surface 171*b* at an approximate top of the right female insert 166*b* (e.g., the mating surface 170*b* and the sloped surface 171*b* forming an angle relative to one another). At the approximate intersection of the mating surface 170*b* and sloped surface 171*b* is a female mating component 172*b* (e.g., a notch). At an opposite end of the sloped surface 171*b* is a retaining flange 174*b*. When the right female insert 166*b* is inserted in the front right catch finger recess opening 162*b*, the right female insert retaining flange 174*b* engages a lip of the front right catch finger recess opening 162*b* thereby preventing the right female insert 166*b* from disengaging from the right catch finger recess opening 162*b* (e.g., the distance from the bottom of the right female insert 166*b* to the top of the retaining flange 174*b* is greater than the distance from the bottom of the front right catch finger recess opening 162*b* to the top of the front right catch finger recess opening 162*b*). Spring mounts 176*b* extend from an inner surface of the right female insert 166*b* (e.g., an inside surface opposite the mating surface 170*b*). One or more springs 178*b* are mounted to the spring mounts 176*b* to bias the right female insert 166*b* towards a center of the catch body 156 when inserted into the front right catch finger 158*b*.

The left male insert 168*a* is inserted into the back left catch finger 160*a*, and as a result is generally rectangularly shaped and generally corresponds in shape to that of the back left catch finger 160*a*. The left male insert 168*a* includes a mating surface 180*a* and a sloped surface 181*a* at an approximate top of the left male insert 168*a* (e.g., the mating surface 180*a* and the sloped surface 181*a* forming an angle relative to one another). At the approximate intersection of the mating surface 180*a* and sloped surface 181*a* is a male mating component 182*a* (e.g., nub, protrusion, etc.). At an opposite end of the sloped surface 181*a* is a retaining flange 184*a*. When the left male insert 168*a* is inserted in the back left catch finger recess opening 164*a*, the left male insert retaining flange 184*a* engages a lip of the front left catch finger recess opening 164*a* thereby preventing the left male insert 168*a* from disengaging from the left catch finger recess opening 164*a* (e.g., the distance from the bottom of the left male insert 168*a* to the top of the retaining flange 184*a* is greater than the distance from the bottom of the front left catch finger recess opening 164*a* to the top of the front left catch finger recess opening 164*a*). Spring mounts 186*a* extend from an inner surface of the left male insert 168*a* (e.g., an inside surface opposite the mating surface 180*a*). One or more springs 188*a* are mounted to the spring mounts 186*a* to bias the left female insert 168*a* towards a center of the catch body 156 when inserted into the back left catch finger 160*a*.

Similarly, the right male insert 168*b* is inserted into the back right catch finger 160*b*, and as a result is generally rectangularly shaped and generally corresponds in shape to that of the back right catch finger 160*b*. The right male insert 168*b* includes a mating surface 180*b* and a sloped surface 181*b* at an approximate top of the right male insert 168*b* (e.g., the mating surface 180*b* and the sloped surface 181*a* forming an angle relative to one another). At the approximate intersection of the mating surface 180*b* and sloped surface 181*b* is a male mating component 182*b* (e.g., nub, protrusion, etc.). At an opposite end of the sloped surface 181*b* is a retaining flange 184*b*. When the right male insert 168*b* is inserted in the back right catch finger recess opening 164*b*, the right male insert retaining flange 184*b* engages a lip of the front right catch finger recess opening 164*b* thereby preventing the right male insert 168*b* from disengaging from the right catch finger recess opening 164*b* (e.g., the distance from the bottom of the right male insert 168*b* to the top of the retaining flange 184*b* is greater than the distance from the bottom of the front right catch finger recess opening 164*b* to the top of the front right catch finger recess opening 164*b*). Spring mounts 186*b* extend from an inner surface of the right male insert 168*b* (e.g., an inside surface opposite the mating surface 180*b*). One or more springs 188*b* are mounted to the spring mounts 186*b* to bias the right female insert 168*b* towards a center of the catch body 156 when inserted into the back right catch finger 160*b*.

As the left female insert 166*a* and the left male insert 168*a* are both biased towards a center of the catch body 156, they are also biased towards each other. As a result, the left female insert mating surface 170*a* contacts the left male insert mating surface 180*a*, and the left female insert female mating component 172*a* receives therein the left male insert male mating component 182*a*. As a result, the left female insert sloped surface 171*a* and the left male insert sloped surface 181*a* insert downwardly toward a center of the catch body forming a generally "V" shape. As shown in FIG. 7, this general "V" shape facilitates a user feeding ribbon, string, and/or wire downwardly past the engagement of the female mating component 172*a* and the male mating component 182*a* to be secured between the left female insert 166*a* and the left male insert 168*a*. The engagement of the female mating component 172*a* and the male mating component 182*a* (e.g., the catch) further secures the ribbon, string, and/or wire and prevents accidental disengagement.

Similarly, as the right female insert 166*b* and the right male insert 168*b* are both biased towards a center of the catch body 156, they are also biased towards each other. As a result, the right female insert mating surface 170*b* contacts the right male insert mating surface 180*b*, and the right female insert female mating component 172*b* receives therein the right male insert male mating component 182*b*. As a result, the right female insert sloped surface 171*b* and the right male insert sloped surface 181*b* insert downwardly toward a center of the catch body forming a generally "V" shape. As shown in FIG. 7, this general "V" shape facilitates a user feeding ribbon, string, and/or wire downwardly past the engagement of the female mating component 172*b* and the male mating component 182*b* to be secured between the left female insert 166*b* and the left male insert 168*b*. The engagement of the female mating component 172*b* and the male mating component 182*b* (e.g., the catch) further secures the ribbon, string, and/or wire and prevents accidental disengagement.

Further, each of the left female insert 166*a*, the right female insert 166*b*, the left male insert 168*a*, and the right male insert 168*b* move independently of one another. Each also can pivot and/or slide within their respective catch finger recess opening (e.g., depending on the number and location of the springs, the force applied, etc.).

The catch assembly 16 disclosed herein is an improvement of the bow making device disclosed in U.S. Pat. No. 8,403,145 to Yip et al., the contents of which are incorporated herein by reference. More specifically, the plurality of catch fingers and inwardly biased inserts is an improvement of the bow making device of U.S. Pat. No. 8,403,145 to Yip et al. as (1) the plurality of fingers facilitate more versatile bow making (e.g., by providing workable spaces for the ribbon and/or wire, etc.) and/or (2) the inwardly biased inserts with mating components better secure ribbon placement during the bow making process and prevent accidental disengagement of the ribbon from the catch assembly 16.

Figure 11:
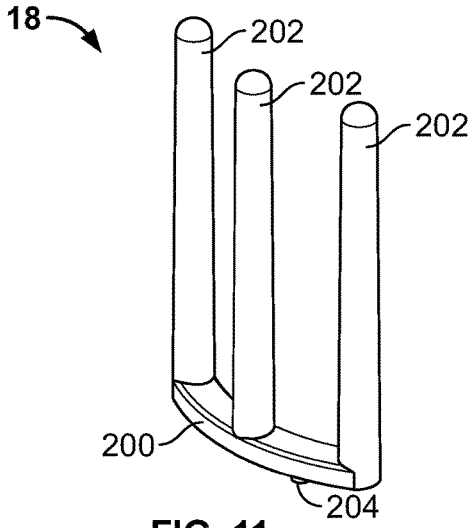
FIG. 11 is a top perspective view of a small fork of FIG. 1.
Figure 12:
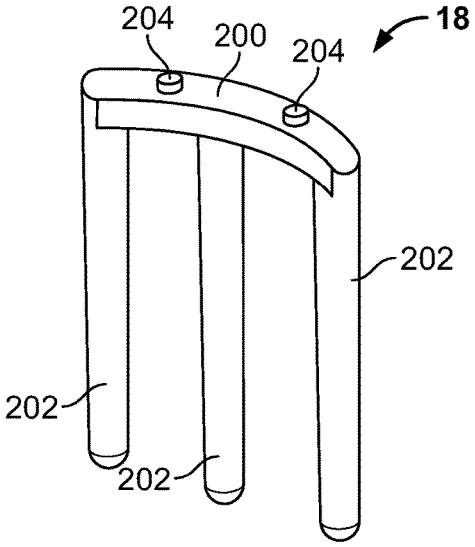
FIG. 12 is a bottom perspective view of the small fork of FIG. 11.

FIGS. 11-12 are views of a small fork 18 of the bow making device 10. More specifically, FIG. 11 is a top perspective view of a small fork 18 of FIG. 1. FIG. 12 is a bottom perspective view of the small fork 18 of FIG. 11. The small fork 18 is used to weave ribbon between prongs 202 thereof when making a bow (e.g., a small bow).

The small fork 18 can be removably mounted to the base assembly 12 to form a general circle of upstanding prongs to facilitate bow making. Each small fork 18 includes an arced base 200 which generally corresponds in size and shape to that of the base assembly upper body component small fork mounting grooves 84. The small fork 18 includes one or more prongs 202 extending from a top surface of the arced base 200. More specifically, the small fork 18 could have three prongs, a first prong at one end of the base, a second prong at an opposite end of the base, and a third prong therebetween. The small fork 18 further includes one or more nubs 204 extending from a bottom surface of the arced base 200 (e.g., in a direction opposite to that of the one or more prongs). The one or more nubs 204 correspond in size, shape, and positioning to that of the base assembly upper body component small arced groove mounting holes 86. When assembled to the base assembly 12, the plurality of small forks 18 form a general circle of prongs 202.

Figure 13:
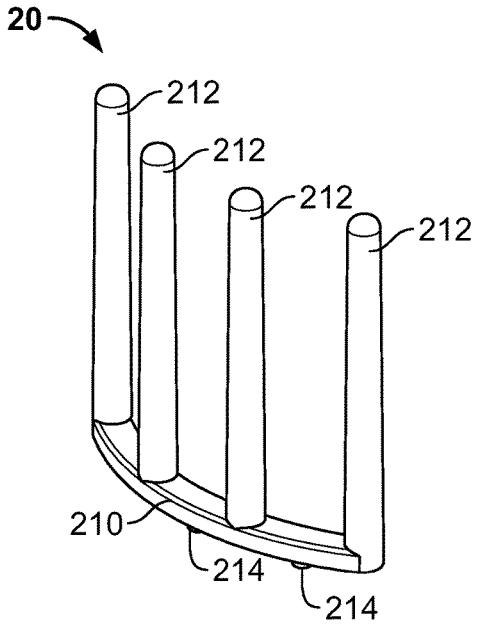
FIG. 13 is a top perspective view of the large fork of FIG. 1.
Figure 14:
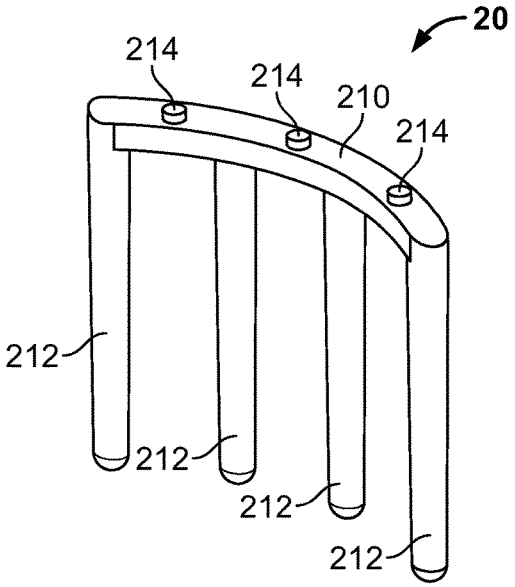
FIG. 14 is a bottom perspective view of the large fork of FIG. 13.

FIGS. 13-14 are views of a large fork 20 of the bow making device 10. More specifically, FIG. 13 is a top perspective view of the large fork 20 of FIG. 1 and FIG. 14 is a bottom perspective view of the large fork 20 of FIG. 13. The large fork 20 is used to weave ribbon between prongs 212 thereof when making a bow (e.g., a large bow).

The large fork 20 can be removably mounted to the base assembly 12 to form a general circle of upstanding prongs to facilitate bow making. Each large fork 20 includes an arced base 210 which generally corresponds in size and shape to that of the base assembly upper body component large fork mounting grooves 88. The large fork 20 includes one or more prongs 212 extending from a top surface of the arced base 210. More specifically, the large fork 20 could have four prongs, a first prong at one end of the base, a second prong at an opposite end of the base, and two prongs therebetween. The large fork 20 further includes one or more nubs 214 extending from a bottom surface of the arced base 210 (e.g., in a direction opposite to that of the one or more prongs). The one or more nubs 214 correspond in size, shape, and positioning to that of the base assembly upper body component large arced groove mounting holes 90. When assembled to the base assembly 12, the plurality of large forks 20 form a general circle of prongs 212. The circle of prongs 212 formed by the large forks 20 having more prongs and being larger than the circle of prongs 202 formed by the small forks 18.

Figure 15:
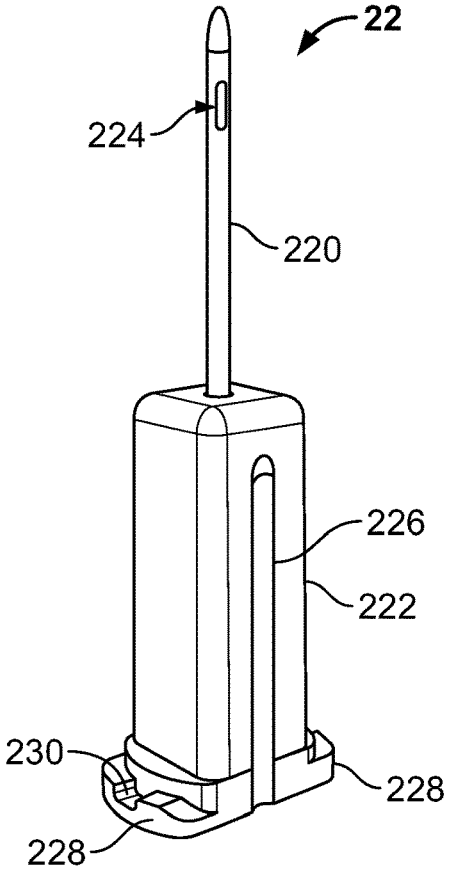
FIG. 15 is a top perspective view of the needle assembly of FIG. 1.
Figure 16:
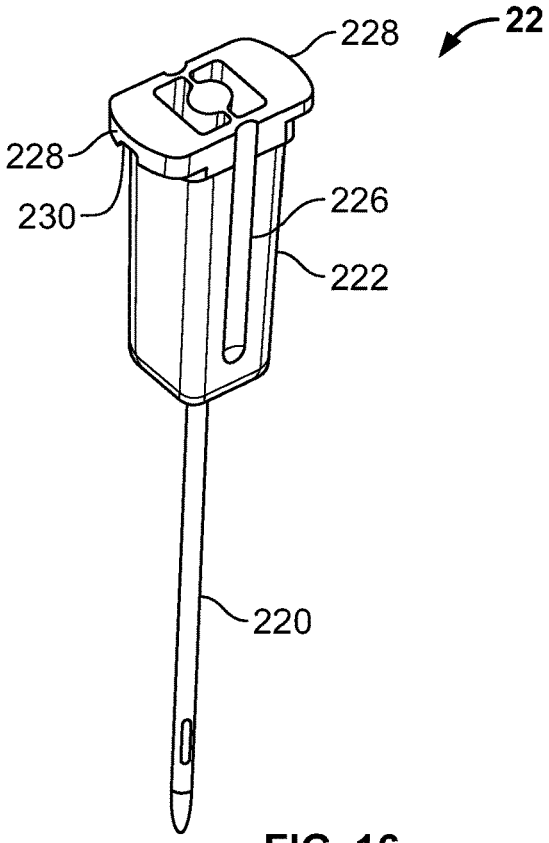
FIG. 16 is a bottom perspective view of the needle assembly of FIG. 15.

FIGS. 15-16 are views of a needle assembly 22 of the bow making device 10. More specifically, FIG. 15 is a top perspective view of the needle assembly 22 of FIG. 1, and FIG. 16 is a bottom perspective view of the needle assembly 22 of FIG. 15. The needle assembly 22 is used with the small forks 18 and/or large forks 20 in making a bow. As ribbon is woven through prongs of the forks, the ribbon is placed onto the needle 220 of the needle assembly 22 (so that the needle 220 punctures the ribbon) at each pass back through the center. This secures the placement of the ribbon in making a bow. Additionally, after the bow is finished, thread (e.g., string) can be fed through the eye 224 the needle 220 so that when the ribbon is removed from the needle 220, the tread is fed through the ribbon, thereby making the bow easier to finish.

The needle assembly 22 includes a needle 220 and a mount 222. The needle includes an eye 224 in the body of the needle near the point (e.g., tip) of the needle, such as to receive thread therethrough. The mount 222 includes a side groove 226, one or more flanges 228, and a dimple 230. More specifically, the needle 220 extends from a top surface of the mount 222 (e.g., from a hole in the top of the mount 222) so that the point of the needle is extending from the mount 222. The side groove 226 could be sized and shaped to engage the base assembly upper body component needle assembly holder hinged protrusion 75 to secure the needle assembly 22 in the base assembly upper component needle assembly holder 74.

One or more flanges 228 extend outwardly from a bottom of the mount 222. At least one of the flanges 228 could have a dimple 230 on a top surface thereof. More specifically, a first flange 228 extending from a front of the mount 222 and a second flange 228 extending from a back of the mount 222 (in a direction opposite to the first base). The widest portion of the mount 222 is less than the distance between the base assembly upper body component needle retaining shelves 78, and the distance from the ends of the first and second flanges 228 is more than the distance between the base assembly upper body component needle retaining shelves 78 but less than the diameter of the base assembly upper body component needle mounting receptacle 76. Accordingly, the mount 222 can be inserted into the needle mounting receptacle 76 in a first orientation (e.g., unlocked orientation) where no portion of the needle mount flanges 228 align with the base assembly upper body component needle retaining shelves 78. Once inserted, the needle mount 222 can be rotated to a second orientation (e.g., locked orientation) where at least a portion of the needle mount flanges 228 align with the base assembly upper body component needle retaining shelves 78, thereby securing the needle assembly 22 to the base assembly 12. Further, a protrusion on a lower surface of one of the base assembly upper body component needle retaining shelves 78 could removably engage the needle mount dimple 230 when oriented to the second orientation, thereby providing tactile feedback for a user as to when the needle mount 222 is properly oriented and secured within the base assembly upper body component needle mounting receptacle 76, and also rotationally securing the needle assembly 22.

Figure 17:
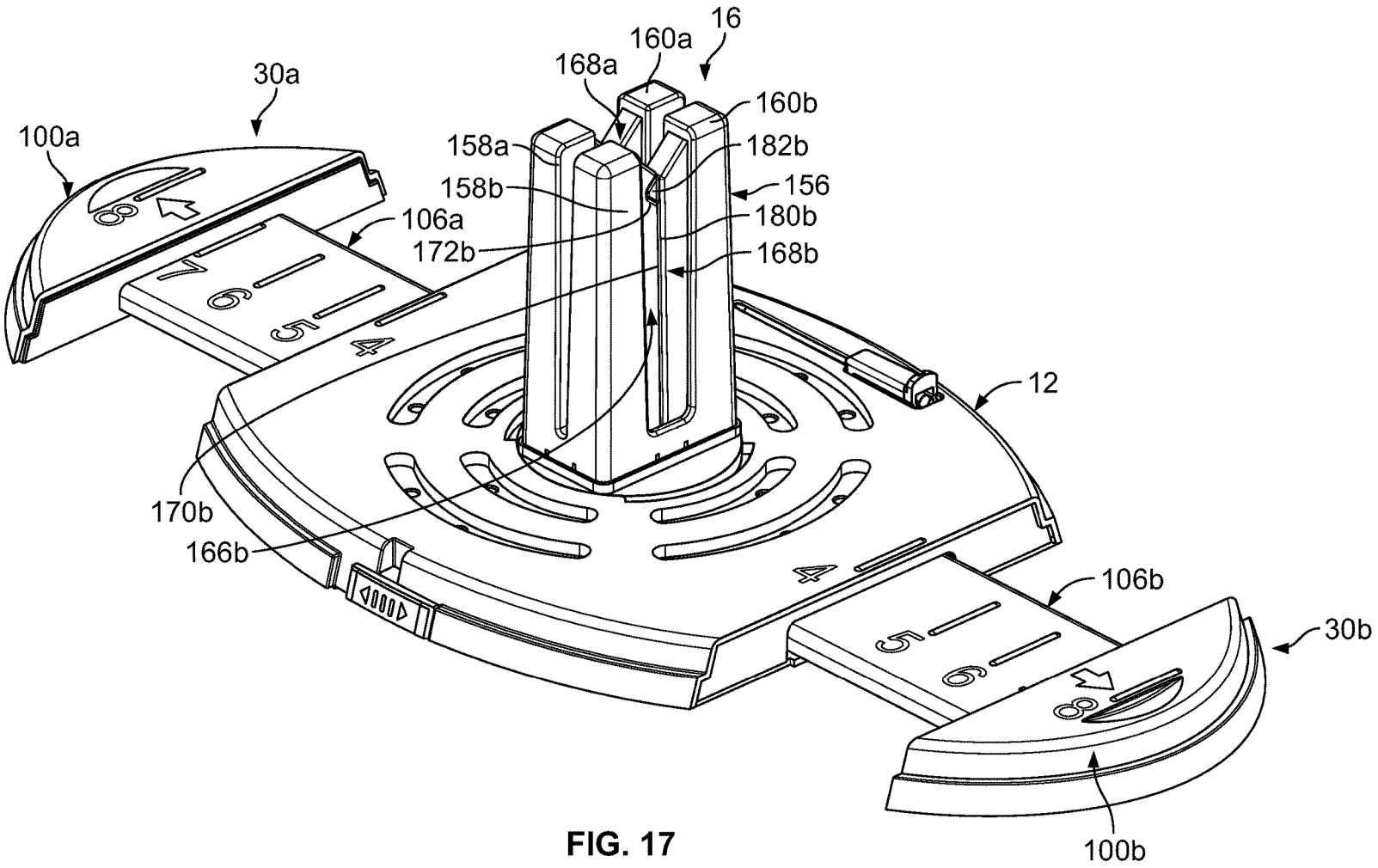
FIG. 17 is a perspective view of the catch assembly attached to the base assembly with the base assembly in the extended orientation of FIG. 4.

FIG. 17 is a perspective view of the catch assembly 16 attached to the base assembly 12, the base assembly 12 in the extended orientation of FIG. 4. To assemble, the catch assembly base 150 is inserted into the catch mounting receptacle 80 in a first orientation (e.g., unlocked orientation). Once inserted, the catch assembly 16 is rotated (e.g., 90 degrees) to a second orientation (e.g., locked orientation), where a protrusion on a lower surface of one of the base assembly upper body component catch retaining shelves 82 removably engages the catch assembly base dimple 154 rotationally securing the catch assembly 16 within the base assembly upper body component catch mounting receptacle 80. In the second orientation, at least a portion of the catch base flanges 152 align with the base assembly upper body component catch retaining shelves 82, thereby securing the catch base assembly 16 to the base assembly 12.

In the second orientation, the catch assembly body front left catch finger **158*a* and catch assembly body front right catch finger 158*b* are positioned closer to the base assembly upper body component arced front wall 68, and the catch assembly body back left catch finger 160***a* and the catch assembly body back right catch finger 160*b* are positioned closer to the base assembly upper body component arced back wall 72. As discussed above, the left female insert 166*a* and left male insert 168*a* are inwardly biased towards the center to contact each other such that the left female insert mating component 172*a* engages the left male insert mating component 182*a*. Similarly, the right female insert 166*b* and right male insert 168*b* are inwardly biased towards the center to contact each other such that the right female insert mating component 172*b* engages the right male insert mating component 182*b*.

To use the catch assembly 16, a user could feed ribbon from a top of the catch assembly 16 downwardly between the left female insert 166*a* and left male insert 168*a*. As the user feeds the ribbon downwardly, the left female insert sloped surface 171*a* and the left male insert sloped surface 181*a* guide the ribbon towards the topmost point of contact of the left female insert 166*a* with the left male insert 168*a*. The ribbon continues to be fed downwardly until the ribbon separates the left female insert 166*a* from the left male insert 168*a* to be secured therebetween. Then the ribbon continues to be fed downwardly passed the left female insert mating component 172*a* and the left male insert mating component 182*a*.

Similarly, a user could feed ribbon from a top of the catch assembly 16 downwardly between the right female insert 166*b* and a right male insert 168*b*. As the user feeds the ribbon downwardly, the right female insert sloped surface 171*b* and the right male insert sloped surface 181*b* guide the ribbon towards the topmost point of contact of the right female insert 166*b* with the right male insert 168*b*. The ribbon continues to be fed downwardly until the ribbon separates the right female insert 166*b* from the right male insert 168*b* to be secured therebetween. Then the ribbon continues to be fed downwardly passed the right female insert mating component 172*b* and the right male insert mating component 182*b*.

A user can measure portions of the ribbon using indicia on the base assembly upper body component 28, the base assembly left retractable arm 30*a*, and the base assembly right retractable arm 30*b*. More specifically, a user can measure a left portion of the ribbon secured between and extending from the catch assembly left female insert 166*a* and the catch assembly left male insert 168*a* by extending the ribbon along the base assembly upper body component 28 and/or base assembly left retractable arm 30*a* and using the measuring indicia on the base assembly upper body component top wall 62, the base assembly left retractable arm handle portion 100*a*, and/or the base assembly left retractable arm ruler portion 106*a* to measure the length. Similarly, additionally or alternatively, a user can measure a right portion of the ribbon secured between and extending from the catch assembly right female insert 166*b* and the catch assembly right male insert 168*b* by extending the ribbon along the base assembly upper body component 28 and/or base assembly right retractable arm 30*b* and using the measuring indicia on the base assembly upper body component top wall 62, the base assembly right retractable arm handle portion 100*b*, and/or the base assembly left retractable arm ruler portion 106*b* to measure the length.

The user then folds the left portion of the ribbon back onto itself and back through the left female insert 166*a* and left male insert 168*a* and/or folds the right portion of the ribbon back onto itself and back through the right female insert 166*a* and right male inset 168*a*, and repeats the above. The user continues to weave the ribbon through the spaces between the fingers (e.g., between the catch assembly body front left finger 158*a* and the catch assembly body back left finger 160*a* and/or between the catch assembly body front right finger 158*b* and the catch assembly body back right finger 160*b*), until the ribbon has formed a bow.

Before, during, or after, a user could feed string (e.g., wire) through the catch assembly body front left finger 158*a* and the catch assembly body front left finger 158*b* and/or between the catch assembly body back left finger 160*a* and the catch assembly body back left finger 160*b*. A user can then use the string to set the ribbon placement (e.g., as the ribbon is secured between the fingers of the catch assembly 16) thereby making a bow. Once the bow is made and set, it can be removed from the catch assembly 16. Once the user is done with the catch assembly 16, the catch assembly 16 can be rotated to the first position and removed from the base assembly 12.

Figure 18:
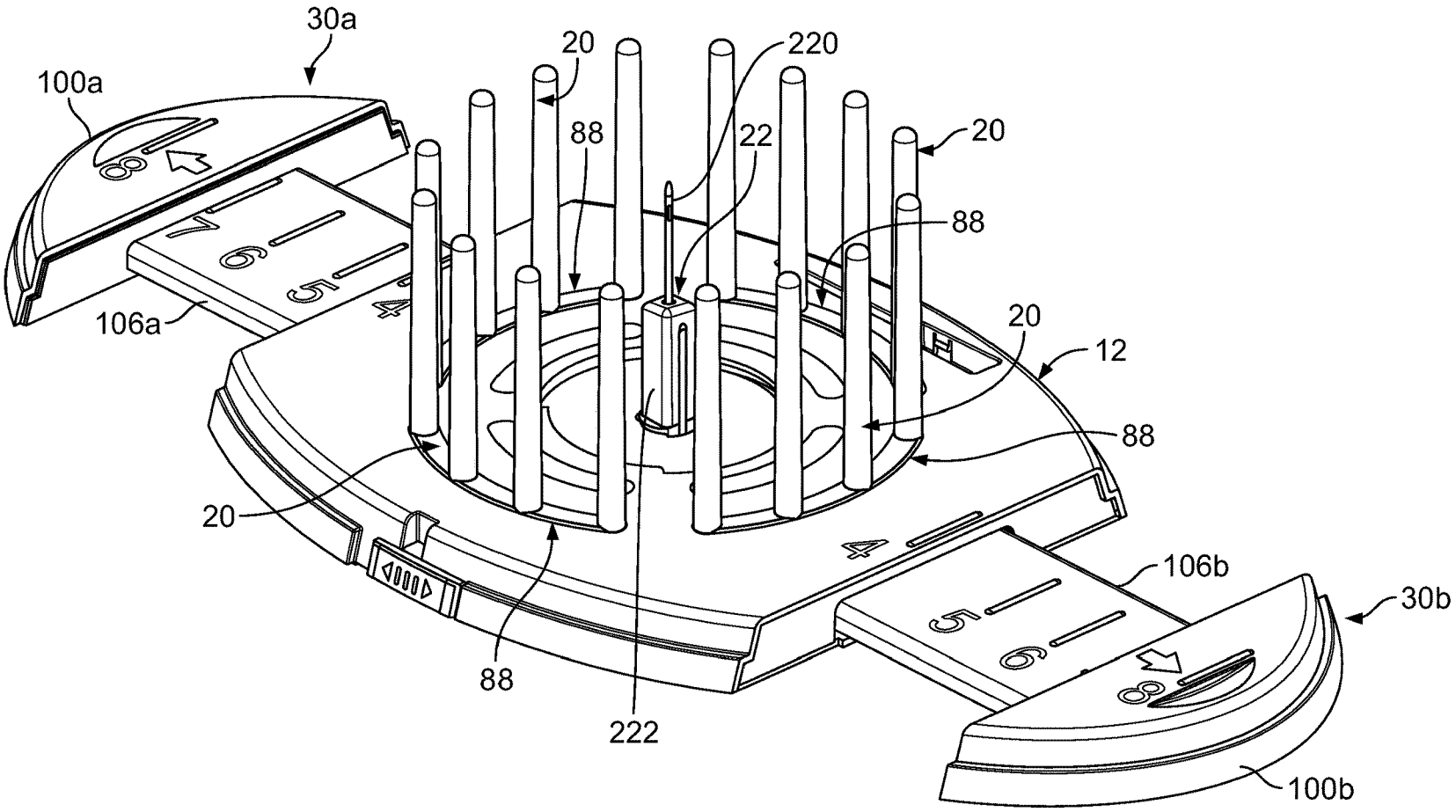
FIG. 18 is a perspective view of the needle assembly and the plurality of large forks attached to the base assembly with the base assembly in the extended orientation of FIG. 4.

FIG. 18 is a perspective view of the needle assembly 22 and plurality of large forks 20 attached to the base assembly 12, the base assembly 12 in the extended orientation of FIG. 4. To assemble, the needle assembly mount 222 is inserted into the needle mounting receptacle 76 in a first orientation (e.g., unlocked orientation). Once inserted, the needle assembly 22 is rotated (e.g., 90 degrees) to a second orientation (e.g., locked orientation), where a protrusion on a lower surface of one of the base assembly upper body component needle retaining shelves 78 removably engages the needle mount dimple 230 rotationally securing the needle assembly 22 within the base assembly upper body component needle mounting receptacle 76. In the second orientation, at least a portion of the needle mount flanges 228 align with the base assembly upper body component needle retaining shelves 78, thereby securing the needle assembly 22 to the base assembly 12.

Each of the large forks 20 is mounted to the base assembly 12. More specifically, each of the large fork arced bases 210 is inserted into one of the large fork mounting grooves 88, such that the large fork nubs 214 engage the base assembly upper body component large arced groove mounting holes 90. This provides a general circle of large fork prongs 212 circumscribing the needle assembly 22 inserted into and secured to the base assembly upper body component needle mounting receptacle 76. Similarly, a small circumference of small fork prongs 202 could be used instead of or in addition to the large forks 20 by inserting the small forks 18 in the base assembly upper body component small fork mounting grooves 84. Thus, a user could have a small circle of small fork prongs 202, or a large circle of large fork prongs 212 depending on the needs of the user (e.g., the size of the bow).

A ribbon could then be measured and placed onto the point (e.g., tip) of the needle assembly needle 220 so that the needle assembly needle 220 punctures the ribbon. A user can then measure portions of the ribbon using indicia on the base assembly upper body component 28, the base assembly left retractable arm 30*a*, and the base assembly right retractable arm 30*b*.

More specifically, a user can measure a left portion of the ribbon by extending the ribbon from the needle assembly needle 220 along the base assembly upper body component 28 and/or base assembly left retractable arm 30*a* and using the measuring indicia on the base assembly upper body component top wall 62, the base assembly left retractable arm handle portion 100*a*, and/or the base assembly left retractable arm ruler portion 106*a* to measure the length. Similarly, additionally or alternatively, a user can measure a right portion of the ribbon by extending the ribbon from the needle assembly needle 220 along the base assembly upper body component 28 and/or base assembly right retractable arm 30*b* and using the measuring indicia on the base assembly upper body component top wall 62, the base assembly right retractable arm handle portion 100*b*, and/or the base assembly left retractable arm ruler portion 106*b* to measure the length.

Each end of the ribbon can then be fed around a large fork prong 212 and folded back to the center, and the user repeats the above. More specifically, the ribbon is again placed onto the point of the needle assembly needle 220 so that the needle assembly needle 220 punctures the ribbon, and then portions of the ribbon can be measured, and then fed around a different large fork prong 212.

As ribbon is woven through prongs of the forks, portions of the ribbon continue to be placed onto the needle 220 of the needle assembly 22 (so that the needle 220 punctures the ribbon) at each pass back through the center. In other words, a user weaves the ribbon through the large fork prongs 212 to create a desired bow design and at one or more passes punctures the ribbon with the needle assembly needle 222.

Before, during, or after, a user could feed string (e.g., wire) through the needle assembly needle eye 224. Once the ribbon is in the final desired design, the user can lift the ribbon (e.g., where the ribbon portions have been punctured by the needle assembly needle 220. As the ribbon portions translate past the needle assembly needle eye 224, the string inserted through the needle assembly needle eye 224 is fed through the ribbon holes (created by the needle assembly needle 220), thereby setting the ribbon in place and creating a bow. Once the user is done, the needle assembly 22 can be rotated to the first position and removed from the base assembly 12, and each of the large forks 20 can be removed from the base assembly 12.

Having thus described the invention in detail, it is to be understood that the foregoing description is not intended to limit the spirit or scope thereof. It will be understood that the embodiments of the present invention described herein are merely exemplary and that a person skilled in the art may make many variations and modification without departing from the spirit and scope of the invention. All such variations and modifications, including those discussed above, are intended to be included within the scope of the invention.

What is claimed is:

1. A bow making device kit, comprising:

a base assembly having a body component defining a needle mounting receptacle, a catch mounting receptacle, and fork mounting grooves in a top surface thereof;

a needle assembly removably attachable to the needle mounting receptacle, the needle assembly including a needle mount with a needle extending therefrom, the needle vertically oriented when the needle assembly is attached to the needle mounting receptacle;

a plurality of forks removably attachable to the fork mounting grooves, each fork having a base with a plurality of prongs extending therefrom, the plurality of forks circumscribing the needle assembly when the needle assembly and the plurality of forks are attached to the base assembly; and a catch assembly removably attachable to the catch mounting receptacle, the catch assembly having a plurality of fingers with movable inserts biased inwardly to contact each other.

2. The bow making device kit of claim 1, wherein the needle assembly is attached to the needle mounting receptacle.

3. The bow making device kit of claim 1, wherein the plurality of forks are attached to the fork mounting grooves.

4. The bow making device kit of claim 1, wherein the catch assembly is attached to the catch mounting receptacle.

5. The bow making device kit of claim 1, the base assembly further comprising a left retractable arm slidably attached to a left side of the body component, and a right retractable arm slidably attached to a right side of the body component.

6. The bow making device kit of claim 5, wherein top surfaces of the body component, the left retractable arm, and the right retractable arm include measuring indicia.

7. The bow making device kit of claim 1, further comprising a lid assembly removably attachable to the base assembly, the lid assembly including a plurality of engagement segments extending from an inside thereof sized and shaped to removably secure the plurality of forks thereto.

8. The bow making device kit of claim 1, wherein the needle mounting receptacle comprises inwardly extending retaining shelves.

9. The bow making device kit of claim 8, wherein the needle assembly is insertable and removable from the needle mounting receptacle when oriented in a first orientation, and secured and unremovable when oriented in a second orientation.

10. The bow making device kit of claim 1, wherein the catch mounting receptacle comprises inwardly extending retaining shelves.

11. The bow making device kit of claim 10, wherein the catch assembly is insertable and removable from the needle mounting receptacle when oriented in a first orientation, and secured and unremovable when oriented in a second orientation.

12. The bow making device kit of claim 1, wherein each of the movable inserts have a vertical mating surface and a sloped surface at a top thereof.

13. The bow making device kit of claim 12, wherein at least one of the movable inserts includes a female mating component at the intersection of the vertical mating surface and the sloped surface, at least one of the movable inserts includes a male mating component at the intersection of the vertical mating surface and the sloped surface, and the female mating component is sized and shaped to engage the male mating component.

14. The bow making device kit of claim 1, wherein each of the fork mounting grooves include one or more mounting holes, each of the plurality of forks includes nubs extending from a bottom surface of the base, the nubs sized and positioned to engage the mounting holes of the fork mounting grooves.

15. A bow making device, comprising:

a base assembly having a body component;

a catch assembly for mounting to a top surface of the base assembly, the catch assembly having a plurality of upwardly extending fingers, a left pair of fingers having movable inserts biased inwardly to contact each other, and a right pair of fingers having movable inserts biased inwardly to contact each other, the left pair of fingers adjacent to and separate from the right pair of fingers to receive ribbon therebetween.

16. The bow making device of claim 15, the base assembly further comprising a left retractable arm slidably attached to a left side of the body component, and a right retractable arm slidably attached to a right side of the body component.

17. The bow making device of claim 16, wherein top surfaces of the body component, the left retractable arm, and the right retractable arm include measuring indicia.

18. The bow making device of claim 15, wherein the body component of the base assembly defines a catch mounting receptacle, the catch mounting receptacle comprises inwardly extending retaining shelves.

19. The bow making device of claim 18, wherein the catch assembly is insertable and removable from the needle mounting receptacle when oriented in a first orientation, and secured and unremovable when oriented in a second orientation.

20. The bow making device of claim 15, wherein each of the movable inserts have a vertical mating surface and a sloped surface at a top thereof.

21. The bow making device of claim 20, wherein at least one of the movable inserts includes a female mating component at the intersection of the vertical mating surface and the sloped surface, at least one of the movable inserts includes a male mating component at the intersection of the vertical mating surface and the sloped surface, and the female mating component is sized and shaped to engage the male mating component.

22. A bow making device, comprising a catch assembly for receiving and retaining ribbon during making of a bow, wherein the catch assembly includes a first upwardly extending finger having a first insert with a male component proximate a top thereof, and a second upwardly extending finger having a second insert with a female component proximate a top thereof, wherein the first insert and the second insert are biased inwardly to contact each other, and wherein the male component of the first insert engages the female component of the second insert when the first insert and the second insert contact each other.

23. The bow making device of claim 22, further comprising a base assembly having a body component, wherein the catch assembly is mountable to the base assembly.

24. The bow making device of claim 22, the base assembly further comprising a left retractable arm slidably attached to a left side of the body component, and a right retractable arm slidably attached to a right side of the body component.

25. The bow making device of claim 24, wherein top surfaces of the body component, the left retractable arm, and the right retractable arm include measuring indicia.

26. The bow making device of claim 20, wherein the body component of the base assembly defines a catch mounting receptacle, the catch mounting receptacle comprises inwardly extending retaining shelves.

27. The bow making device of claim 26, wherein the catch assembly is insertable and removable from the needle mounting receptacle when oriented in a first orientation, and secured and unremovable when oriented in a second orientation.

28. The bow making device of claim 20, wherein each of the movable inserts have a vertical mating surface and a sloped surface at a top thereof.

29. The bow making device of claim 28, wherein the female mating component is positioned at the intersection of the vertical mating surface and the sloped surface, and the male mating component is positioned at the intersection of the vertical mating surface and the sloped surface.

30. A method of using a bow making device, comprising:

puncturing a section of ribbon with a needle of a needle assembly, the needle assembly attached to a needle mounting receptacle of a base assembly;

weaving an end of the ribbon around a prong of a plurality of forks circumscribing the needle assembly and back towards the needle assembly, each fork having a base with a plurality of prongs extending therefrom, and each of the plurality of forks attached to fork mounting grooves of the base assembly; and again puncturing another section of the ribbon with the needle;

repeating the steps of weaving and puncturing sections of the ribbon;

threading string through an eye of the needle proximate a tip of the needle; and removing the ribbon woven in the bow design from the needle such that, as the ribbon is translated past the eye of the needle, the string is fed through the ribbon securing said sections together.

31. The method of claim 30, wherein the needle assembly is inserted into the needle mounting receptacle.

32. The method of claim 30, wherein each of the plurality of forks is inserted into the fork mounting grooves of the base assembly.

33. The method of claim 30, further comprising measuring portions of the ribbon extending from the needle assembly using measuring indicia on retractable arms slidably attached to the base assembly.

* * * * *